US010124199B2

(12) United States Patent
Andon

(10) Patent No.: US 10,124,199 B2
(45) Date of Patent: Nov. 13, 2018

(54) TRAMPOLINES AND TRAMPOLINE PARKS

(71) Applicant: Vuly Property Pty Ltd., Wakerley (QLD) (AU)

(72) Inventor: Joe Andon, Wakerley (AU)

(73) Assignee: VULY PARKS IP HOLDINGS PTY LTD, Wakerly (QLD) (AU)

( * ) Notice: Subject to any disclaimer, the term of this patent is extended or adjusted under 35 U.S.C. 154(b) by 37 days.

(21) Appl. No.: 14/898,309

(22) PCT Filed: Jul. 10, 2015

(86) PCT No.: PCT/AU2015/000398
§ 371 (c)(1),
(2) Date: Dec. 14, 2015

(87) PCT Pub. No.: WO2016/004462
PCT Pub. Date: Jan. 14, 2016

(65) Prior Publication Data

US 2016/0199681 A1 Jul. 14, 2016

(30) Foreign Application Priority Data

Jul. 11, 2014 (AU) ..... 2014902690
Nov. 13, 2014 (AU) ..... 2014904563
(Continued)

(51) Int. Cl.
*A63B 5/11* (2006.01)

(52) U.S. Cl.
CPC ..... *A63B 5/11* (2013.01)

(58) Field of Classification Search
CPC .... A63B 5/11; A63B 5/10; A63B 5/08; A63B 2005/085; A63B 2067/005
(Continued)

(56) References Cited

U.S. PATENT DOCUMENTS 3,233,895 A * 2/1966 Grelle ..... A63B 5/11 182/139
4,460,170 A * 7/1984 Lundberg ..... A63B 5/08 267/158
(Continued)

FOREIGN PATENT DOCUMENTS

NL 039182 * 11/2011 ..... A63B 5/11
NL 1039182 C 5/2013

OTHER PUBLICATIONS

International Search Report & Written Opinion in corresponding application PCT/AU2015/000398 dated Oct. 19, 2015.

*Primary Examiner* — Garrett Atkinson
(74) *Attorney, Agent, or Firm* — Abelman, Frayne & Schwab

(57) ABSTRACT

A trampoline or trampoline system including a frame or other foundation;

biasing means mounted on or to said frame or other foundation; and a plurality of jumping mats connected to selected first ones of said biasing means respectively above said frame or other foundation in side by side relationship, said selected first ones of said biasing means being arranged to bias said plurality of mats outwards to tension said mats, and said plurality of mats being operatively connected to each other along respective adjacent portions thereof and/or to selected second ones of said biasing means along their respective adjacent portions, said second ones of said biasing means being arranged to bias adjacent ones of said plurality of mats upwards and/or outwards away from their respective centers and/or towards each other.

9 Claims, 17 Drawing Sheets

(30) Foreign Application Priority Data

Dec. 4, 2014 (AU) ..... 2014904910
Dec. 30, 2014 (AU) ..... 2014905301
Feb. 2, 2015 (AU) ..... 2015900307

(58) Field of Classification Search
USPC ..... 482/26–32
See application file for complete search history.

(56) References Cited

U.S. PATENT DOCUMENTS 5,336,135 A * 8/1994 Keyvani ..... A63B 5/11 182/137
6,663,538 B2 * 12/2003 Yoon ..... A63B 5/11 482/27
7,468,020 B2 * 12/2008 Lai ..... A63B 5/11 16/324
8,657,696 B1 * 2/2014 Gurley ..... A63B 5/11 472/92
8,672,813 B2 * 3/2014 West ..... A63B 5/11 482/23
8,911,331 B2 * 12/2014 DeBlanco ..... A63B 5/11 482/27
2002/0098948 A1 * 7/2002 Yoon ..... A63B 5/11 482/27
2007/0010374 A1 * 1/2007 Widich ..... A63B 5/11 482/27
2011/0287899 A1 * 11/2011 West ..... A63B 5/11 482/27
2013/0196823 A1 * 8/2013 DeBlanco ..... A63B 5/11 482/27
2013/0310223 A1 * 11/2013 Canales ..... A63B 5/11 482/27
2014/0371031 A1 * 12/2014 Allen ..... A63B 5/11 482/27

* cited by examiner

TRAMPOLINES AND TRAMPOLINE PARKS

CROSS-REFERENCE TO RELATED APPLICATIONS

This application is a National Phase of PCT/AU2015/000398, filed Jul. 10, 2015 which claims priority from Australian Patent Application No. 2014902690 filed Jul. 11, 2014, Australian Patent Application No. 2014904563, filed Nov. 13, 2014, Australian Patent Application No. 2014904910, filed Dec. 4, 2014, Australian Patent Application No. 2014905301, filed Dec. 30, 2014 and Australian Patent Application No. 2015900307, filed Feb. 2, 2015, the disclosures herewith of each of same being incorporated by reference.

This invention relates to trampolines. The invention has particular application to trampolines for use in multiples of two or more adjacent trampolines, for example, for use in trampoline parks.

Trampoline parks typically include sections where multiple trampolines are arranged side by side with the jumping mats horizontal. In some parks, some trampolines can have part of the jumping mat extending horizontally and contiguous with a part which is inclined to the horizontal and perhaps even close to vertical. In some parks, some of the trampolines with horizontal mats are adjacent trampoline with mats inclined to the horizontal.

Trampolines which are currently used in trampoline parks typically include a steel frame with a rectangular flexible jumping mat secured to the frame by a large number of spaced apart extension springs, the axes of which are coplanar with the mat, and are arranged to extend and contract as a person jumps on the mat in order to give "bounce".

In such trampolines the extension springs and the space between the jumping mat and the frame across which the extension springs extend is typically covered by a padded safety barrier (or "padding") extending about the mat. That space is typically in the order of 300 mm wide but can be wider or narrower depending on the size of the trampoline. Thus, where two trampolines are arranged together with ones of said adjacent frames abutting, the spaces together can be in the order of 400 mm to 800 mm wide. Typically, a full width piece of safety padding is used to cover the adjacent springs of both trampolines and consequently such padding can be up to a meter wide in some cases. Such padded safety barriers are typically secured to the steel frame by straps, clips, hook and loop fasteners or the like to ensure that the springs and part of the lumping mat inwards from the edges are well covered for the protection of jumpers using the trampolines.

It will be appreciated that the safety padding interferes with movement of persons from one trampoline mat to the adjacent trampoline mat because safety padding is not intended to be jumped on to produce a bounce but rather to protect a person who misses the mat and accidentally lands on the spring space.

Other forms of trampolines have been developed which allow the jumping mat to be bigger than the frame with the rebound forces being provided by torsion rods or leaf springs extending upwards from a frame below the mat rather than extension coil springs arranged around or about the mat. Some of these trampolines are known as "soft edged trampolines" because the edge of the mat is effectively the edge of the trampoline and there is no hard edge or frame about the mat. In one such trampoline, the mat is typically supported on a large number of circumferentially spaced fibreglass rods which extend upwards, outwards and forwards around the mat from a frame under the mat and are connected to the edge of the mat at their upper ends in spaced apart relationship. The rods are flexible and resilient so as to bend downwards and inwards while twisting as a person's weight comes onto the mat during jumping and to return to the original position as the weight comes off the mat causing a back and forth twisting motion of the mat more or less about a vertical axis. While such trampolines may provide some benefits, they give a different performance feel to users and their performance characteristics are believed not to be as good as the coil spring trampolines. Moreover, such trampolines have to be round in order to provide an acceptable bounce and consequently they do not lend themselves to use in multiples in trampoline parks.

Other trampolines have also been developed which use leaf springs extending upwards from a frame resting on the ground and extending inwards or outwards to connect to the jumping mat. Such trampolines seem to provide relatively good performance characteristics while at the same time providing some of the benefits of known soft edge trampolines, and can also be provided in square, rectangular or other polygonal shapes.

The present invention is aimed at providing trampolines or trampoline systems for use in trampoline parks which have good performance characteristics and allow for relatively safe transition or movement of a person from one trampoline mat to the next.

The present invention provides trampolines and trampoline systems which have a plurality of mats operatively connected to each other in a manner that allows the mats to become substantially continuous and supported in ways which keep the substantially continuous mats taut.

With the foregoing in view, the invention in one aspect resides broadly in a trampoline or trampoline system including:

a frame or other foundation;

biasing means mounted on or to said frame or other foundation; and a plurality of jumping mats operatively connected to selected first ones of said biasing means respectively above said frame or other foundation in side by side relationship, said selected first ones of said biasing means being arranged to bias said plurality of mats outwards to tension said mats, and said plurality of mats being operatively connected to each other along respective adjacent portions thereof and/or to selected second ones of said biasing means along their respective adjacent portions, said second ones of said biasing means being arranged to bias said plurality of mats upwards and/or outwards away from their respective centres and/or towards each other.

In one form the selected second ones of said biasing means are spaced apart flexible and resilient plates, for example, leaf springs. Such leaf springs may be single leaf or multileaf and maybe of varying spring constant along their lengths.

In another aspect, the invention resides broadly in a trampoline or trampoline system including:

a frame or other foundation; and a plurality of jumping mats arranged side by side above said frame or other foundation, at least two adjacent mats of said plurality being held taut by biasing means extending from said frame or foundation and upwards thereto.

In another aspect, the invention resides broadly in a trampoline or trampoline system including:

a frame or other foundation;

a plurality of spaced apart flexible and resilient plates (for example, leaf springs) or plate portions extending generally upwards from said frame or other foundation;

first and second jumping mats connected to selected ones of said plates respectively above said frame or other foundation in side by side relationship, said selected plates along one or more portions of each of said mats being alternate ones or alternate groups of said plates or plate portions and said alternate ones or alternate groups being arranged to bias said first and second jumping mats towards each other.

In another aspect, the invention resides broadly in a trampoline or trampoline system including:

a first frame or first foundation and a second frame or second foundation;

first biasing means mounted on or to said first frame or first foundation and second biasing means mounted on or to said second frame or second foundation;

a plurality of first jumping mats operatively connected to each other in side by side relationship so as to form a first substantially continuous mat and to said plurality of first biasing means about the perimeter of the first substantially continuous mat, said first biasing means being arranged to bias said first continuous mat outwards (away from the centre thereof) to tension it;

a plurality of second jumping mats operatively connected to each other in side by side relationship so as to form a second substantially continuous mat and to said plurality of second biasing means about the perimeter of the second substantially continuous mat, said second biasing means being arranged to bias said second continuous mat outwards (away from the centre thereof) to tension it;

said second substantially continuous may being inclined to said first substantially continuous mat and a portion of the perimeter of said second substantially continuous mat being adjacent a portion of the perimeter of said first substantially continuous mat and connected to a selected group of said plurality of second biasing means, said selected group of second biasing means being at least substantially below said first mat;

third biasing means mounted on or to said first frame or said first foundation below said first substantially continuous mat and arranged to bias said first substantially continuous mat upwards; and fourth biasing means mounted on or to said second frame or said second foundation below said second substantially continuous mat and arranged to bias said second substantially continuous mat upwards (relative to the upper surface of the mat).

In another aspect, the invention resides broadly in a trampoline or trampoline system including:

a first frame or first frame portion and a second frame or second frame portion;

a plurality of spaced apart first biasing means connected to said first frame or first frame portion and a first jumping operatively connected to said plurality of first biasing means about its perimeter, each of said first biasing means being arranged to bias said first jumping mat outwards (away from the centre of the jumping mat) to keep it taut;

a plurality of spaced apart second biasing means connected to said second frame or said second frame portion and a second jumping mat operatively connected to said plurality of second biasing means about its perimeter, each of said second biasing means being arranged to bias said second jumping mat outwards (away from the centre of the jumping mat) to keep it taut;

said second mat being inclined to said first mat and a portion of the perimeter of said second mat being adjacent a portion of the perimeter of said first mat and connected to a selected group of said plurality of second biasing means, said selected group of second biasing means being at least substantially below said first mat.

In such form it is preferred that the biasing means in said selected group of second biasing means be spaced apart in alternate relationship with the spaced apart first biasing means along the adjacent portion of the perimeter of said first mat. In one such preferred form the biasing means along the adjacent portions of the first and second mats are extensible coil springs. In that form it is also preferred that the inclined mat have a cover portion adapted to overlap and cover the horizontal mat for a distance sufficient to cover the first and second biasing means along the adjacent perimeter portions of the first and second mats.

In one such form, the cover portion is an extensible material which is secured adjacent one edge to the horizontal mat by hook and loop fastening material and/or a zipper.

In another form, said first biasing means are flexible and resilient plates (such as leaf springs) at least along the perimeter of the first mat opposite the adjoining or abutting adjacent portion perimeters. In such form, the first and second biasing means along the adjoining or abutting portions or perimeter are preferably extension coil springs.

When flexible and resilient plates are used it is preferred that they be substantially identical in spring constant, at least on the sides which are "free" as in not adjacent to the other or another mat of the plurality of mats so that the mats are generally under the same tension and have substantially the same performance characteristics. If flexible and resilient plates are used for the adjoining perimeter portions, it is also preferred that the selected group of second flexible and resilient plates and the group of first flexible and resilient plates to which the first mat is connected adjacent the second mat be arranged alternately so that consecutive plates along the junction between the two mats connect to opposite mats. Consecutive groups of plates could connect alternately to the alternate mats if desired although it is believed such en arrangement would be less desirable.

Preferably, said frame is constructed of rolled hollow section steel tube and in such form where the biasing means are flexible and resilient plates, it is preferred that the respective spaced apart plates be connected to said tube by extending into the tube through spaced apart slots formed therein, the slots being suitably sized to form a tight fit about the lower end portions of the plates so as to prevent any significant relative movement therebetween. In such form, it is preferred that retaining means be provided to retain the plates in the slots against lifting therefrom.

It is also preferred that the mat be connected to the plates adjacent their upper ends by connector assemblies incorporating a hook and a load bearing fitting mounted in a pocket formed in the mat adjacent its periphery, or a loop attached to or formed in the mat. In such form, it is preferred that the hook be connected at one end to the mat via the load bearing fitting and to the plates at the other end via one or more hook openings formed in the plate adjacent its upper end. A similar arrangement can also be used in cases where extensible coil springs bias the mat to the frame or foundation. However, other means of connecting the mat to the plates could be used if desired.

In yet another aspect, the invention resides broadly in a trampoline or trampoline system including:

a frame or other foundation;

a plurality of biasing means connected to said frame or other foundation and extending therefrom; and first and second jumping mats connected to selected ones of said biasing means respectively above said frame in side by side relationship, said selected biasing means along a portion of each of said mats comprising leaf springs having opposite free ends, said leaf springs being connected to said frame intermediate said free ends and portions of said leaf springs adjacent each of said free ends being above said frame or other foundation and spaced apart along the portion of said mats to which they are connected and wherein one of said mats is connected to said leaf spring at or adjacent one of said free ends and the other of said mats is connected to said leaf spring at or adjacent the other of said free ends to provide alternate connections for said first and second mats.

In such form of the invention it is preferred that the mats be connected to the respective opposite free ends so that downward force applied to either or both mats by jumping on the mat tends to pull the free ends towards or past each other, or further past each other rather than apart.

In another aspect, the invention resides broadly in a trampoline including:

a frame or other foundation;

a plurality of biasing means connected to said frame or other foundation and extending therefrom; and a plurality of jumping mats connected to selected ones of said biasing means respectively above said frame or other foundation in side by side relationship, said selected biasing means along a portion of each of said mats comprising leaf springs having opposite free ends, said leaf springs being connected to said frame or other foundation intermediate said free ends and portions of said leaf springs adjacent each of said free ends being above said frame or other foundation and spaced apart along the portion of said mats to which they are connected, and wherein one of said plurality of mats is connected to said leaf springs at or adjacent one of said free ends and an adjacent one of said plurality of mats is connected to said leaf springs at or adjacent the other of said free ends so as to bias adjacent side by side lumping mats towards each other.

In another aspect, the invention resides broadly in a trampoline or trampoline system including:

a frame or other foundation;

a plurality of biasing means connected to said frame or other foundation and extending therefrom;

a plurality of jumping mats connected to selected ones of said biasing means respectively above said frame in side by side relation, said selected biasing means along a portion of each of said mats comprising leaf springs, said selected leaf springs comprising pairs of opposed leaf springs, the leaf springs of each of said pairs being connected to said frame at or adjacent one end and diverging away from said frame and curving inwards towards each other towards the other end so as to provide a substantially horizontal portion above said frame; and connection means connecting said substantially horizontal portions of said pair of leaf springs such that they move together to transfer forces from one mat to the adjacent mat.

Preferably, all the biasing means are leaf springs and in such form it is preferred that all the leaf springs which are not connecting the mat along adjoining mats extend upwardly from the frame or other foundation. In that respect it has been found that better mat performance and better jump characteristics are obtained by leaf springs which extend upwards from the frame, that is, immediately from the frame rather than inwards or outwards and then upwards. It is also preferred that such leaf springs be sized so as to bend generally in only one direction, for example, in the case of a square mat, the leaf springs would only bend inwards and outwards towards the opposite side of the mat, which would generally include an up and down component as well but no sideways component. That is to say the axis of each spring would bend in a vertical plane only. In a preferred form, the leaf springs each comprise laminated elongate layers of spring steel over a substantial portion of its length. In one such form selected to meet desired rebound characteristics for the mat the leaf springs each comprise different numbers of layers at different places along the length of the spring. However, it is preferred that the leaf springs located along adjoining mats be selected and shaped to provide more up and down bending upon a person lumping on the region of the "joint" between adjacent mats than leaf springs located at the outside of the mats, that is, where the mats do not adjoin another mat. Advantageously, such arrangement allows the joint area to perform in a manner closer to the performance in other parts of each mat.

In yet another aspect, the invention resides broadly in a trampoline or trampoline system including:

a frame or other foundation;

a plurality of biasing means connected to said frame or other foundation and extending therefrom to mat connection means spaced from said frame or other foundation; and first and second jumping mats connected to said plurality of biasing means by said mat connection means and extending away from each other, said biasing means being resiliently deflectable or deformable from a relatively unstrained disposition to a relatively strained disposition, the relatively strained disposition being displaced from the relatively unstrained disposition according to the scale and location of a downward force or load applied to either or both of said jumping mats.

In one form of the invention, the biasing means includes a coil spring like structure constructed of a resilient material (such as spring steel) and formed into a spirally coiled or wound, helix like form with its axis substantially parallel to the join between adjacent jumping mats. In a preferred form, the coil spring is a single constant pitch helix with each ring being able to be squashed to flatten on top and belly out in the middle thereby accommodating a person jumping on the join. That is to say, the biasing means in that form is a coil spring with selected coils forming the plurality of biasing means at least along the connecting portions of adjacent mats. In a much preferred form, the coil spring is formed of flat spring steel. However, other cross sectional shapes and other materials having suitable performance characteristics could be used if desired, for example a coil spring constructed of round spring steel and or fibreglass rod having suitable characteristics.

In another form, the biasing means includes one or more inflatable vessels, preferably formed from elastically resilient material. In one such form, the biasing means includes a cylindrical tube constructed of rubber or a similar flexible and resilient material which is held to the frame or foundation by spaced apart straps and wherein adjacent mats are secured to the tube by selectively releasable straps attached to the mats and passing through loops secured to the frame, for example, by adhesive or rivets.

In another aspect, the invention resides broadly in a trampoline or trampoline system including:

a frame or other foundation;

biasing means connected to said frame or other foundation and extending therefrom; and a plurality of jumping mats operatively connected to each other along respective connecting portions thereof and/or to selected first ones of said biasing means respectively above said frame in side by side relationship, said selected first ones of said biasing means being arranged to bias said plurality of mats outwards to tension said mats and said plurality of mats being operatively connected to selected second ones of said biasing means along their respective connecting portions, said second biasing means being arranged to bias said plurality of mats upwards.

In such form of the invention, it is preferred that said second ones of said biasing means each comprise a leaf spring forming a loop which is closed at the top adjacent the mat and connects to the frame or other foundation at the bottom. In other words, in such form, the leaf spring has two opposed ends which connect to the frame or other foundation and from which the leaf spring extends outwards and upwards for a predetermined distance and then upwards and inwards to form a leaf spring of substantially cylindrical form, "the cylindrical leaf springs".

In such form, the leaf spring can be a fully closed loop, for example by having the ends welded together or bolted together. In one form the two ends are secured together and to the frame by a single bolt arranged to clamp the two overlapping end portions together against a face of a frame member.

In one form, one or more segments and or layers of resiliently stretchable material are interposed between those edges of the mat adjacent one another and the connection to the second ones of said biasing means.

In another form, it is preferred that the mats be connected to the cylindrical leaf springs via abutting mat connectors adapted to hold the adjoining mats together as well as a predetermined distance above the leaf springs. Advantageously, the configuration of the cylindrical leaf springs allows the mat portion at the line of connection (or join) to be an active part of the mat allowing users to jump on the "join". Such configuration also allows the cylindrical leaf springs to "roll" sideways within itself to some extent by deforming the cylindrical shape and thereby providing a horizontal component of bias to the mat at the connecting edge (or join) when a person jumps on one mat as well as an upwards or vertical component of bias.

Additionally, in one much form the second ones of said biasing means permit the edges of adjacent mats to move apart to some extent if jumpers jump on the adjacent mats at the same time thereby reducing double bounce. However, in another form, adjacent mats may be connected to each other by bonding or stitching and to the "cylindrical leaf springs" by the upper portion of the leaf springs being arranged to pass through a loop provided on the underside of the adjacent mat, preferably at or adjacent the line of connection of join. In still yet another form, adjacent mats are connected to each other by an intermediate connecting strip of mat material by hook and loop fasteners and/or zippers thereby allowing individual mats to be removed and replaced if needed. In such form it is preferred that the intermediate connecting strip be secured to the cylindrical leaf springs or other second biasing means as described earlier.

It is also preferred that the connecting portion of each connected mat be formed of a material of greater elasticity than the main part of the mat in order to reduce the effect of "double bounce" from a person lumping on an adjacent mat. It is believed that the elastic material selected should approximate as closely as possible the extensibility of spaced apart horizontal coil springs along the length of the connecting portions.

It will be appreciated that one form of trampoline system described earlier which included a first lumping mat and a second jumping mat inclined to the first mat can be used in a system including adjacent first jumping mats and adjacent inclined mats. That is to say such an arrangement is not limited to one horizontal mat and one inclined mat. Such adjacent mats can be biased "upwards" by the "cylindrical" leaf spring arrangement previously described which lends itself particularly well to such arrangement. However, other arrangements described can be used if desired.

In yet another aspect, the invention resides broadly in a trampoline including:

a frame or other foundation;

a plurality of biasing means connected to said frame or other foundation and extending therefrom; and first and second jumping mats operatively connected to each other along a connecting portion of each thereof and to selected first ones of said biasing means above said frame in side by side relation, said selected first ones of said biasing means being arranged to bias said first and second mats outwards to tension said mats and said first and second mats being operatively connected to selected second ones of said biasing means along said connecting portions, said second biasing means being arranged to bias said first and second mats upwards.

Where abutting mat connectors are used, or even spaced apart mat connectors, it is also preferred that the mat connectors along the connection portions of adjacent mats be themselves connected by flexible or semi-rigid longitudinal connecting means such as hollow fibreglass bars or rods selected and arranged to allow the connectors to work together to some extent by transmitting forces to adjacent connectors in a diminishing order away from the upping force. In that respect, it will be appreciated that each pair of adjoining mats will be connected together by a plurality of connectors and both mats will be attached to each connector. In such form it is also preferred that the flexible or semi-rigid connecting means be secured together between adjacent connectors by securing means such as steel clips selected and arranged to prevent such connecting means from separating.

It is also preferred that the connectors have a rigid outer housing or casing which is adapted to be connected to the relevant leaf spring against relative movement therebetween and that the adjoining mats be connected to the connector against relative movement therebetween. In that respect, the housing includes recesses or cavities adapted to receive therein the longitudinal connecting means.

It is also preferred that the free edge portions of the connecting portions of the adjoining mats be secured to the longitudinal connecting means, for example by engaging in slots provided therein. It is also preferred that the longitudinal connecting means be encased in a flexible and resilient material such as rubber and that the flexible and resilient material be shaped to provided a relatively sharp of abrupt corner at the line where the connecting mats adjoin so as to give the appearance of continuity of the mat across the join. The flexible and resilient material may be overlaid with a flexible and resilient overlay covering the joins and longitudinal connecting means to achieve the desired appearance.

However, in another form of the invention, coil compression springs can be used instead of the cylindrical springs. In such form, the coil springs are connected to the frame or foundation at one end (the lower end) with their axes vertical and to a mat connector at the other end (the upper end) which in turn is connected to the mat above, or more preferably, to the two adjacent mats. In such form, it is preferred that the coil springs along the connecting portions of the adjacent mats be connected to each other by the mat connectors in the manner described above so that the mat connectors can work together in transmitting forces to adjacent connectors and thereby to adjacent springs rather than having the mat along transmitting forces to adjacent springs.

In yet another aspect, the invention resides broadly in a mat connector for connecting adjacent mats of a trampoline including a plurality of mats, the mat connector including:

a housing and two hollow connecting blocks;

the housing including means such as a passage for connecting a leaf spring or other biasing means to the housing, and at least one cavity, recess or passage therein for receiving the two hollow connecting blocks in substantially parallel relationship, the cavity, recess or passage opening to an upper face of the housing for connection of the edge portions of adjacent mats to be connected thereto and to at least one end face of the housing for fitting the connecting blocks thereto, the housing being so made and arranged as to prevent the connecting block escaping from the opening to the upper face.

In still yet another aspect, the invention resides broadly in a mat connector for connecting adjacent mats of a trampoline including a plurality of mats, the mat connector including:

a housing and a connecting block;

the housing including means such as a passage for connecting a leaf spring or other biasing means to the housing, and at least one cavity, recess or passage therein for receiving the connecting block, the cavity, recess or passage opening to an upper face of the housing for connection of the edge portions of adjacent mats to be connected thereto and to at least one end face of the housing for fitting the connecting block thereto, the housing being so made and arranged as to prevent the connecting block escaping from the opening to the upper face, the connecting block two longitudinal spaced apart passages and each longitudinal passage having an opening thereto along its length for receiving therein the edge portion of a mat.

The term "leaf spring" used herein is generally intended to refer to leaf springs having a rectangular cross section. However, it is to be understood that leaf springs of other cross section which might not generally be considered as "leaf springs" are intended to be included within the scope of that term, unless clearly not appropriate. For example, leaf springs of square cross section or round cross section which are capable of carrying out the equivalent function of the leaf springs described and illustrated are herein referred to as "leaf springs".

It is to be understood that the term "side by side" used herein with respect to side by side jumping mats is intended to include mats arranged "end to end" and "side to end" and arrangements where the side of one mat is shorter or longer than the adjacent side of the adjacent mat, and arrangements where a mat may have curved edges and straight edges or adjacent complementary curved edges or edge portions.

It is also to be understood that the term "horizontal" used herein to refer to trampoline mats has been used to distinguish one line of mats from mats which are inclined thereto and approximate an inclined wall, and is not intended to exclude two or more lines of mats which might be inclined to each other with neither being actually "horizontal".

The present invention lends itself to banks of trampoline mats of different polygonal shapes, particularly hexagonal mats which provide for better tension in the corners than square or rectangular trampolines.

In order that the invention may be more readily understood and put into practice reference will now be made to the accompanying drawings wherein.

Figure 1:
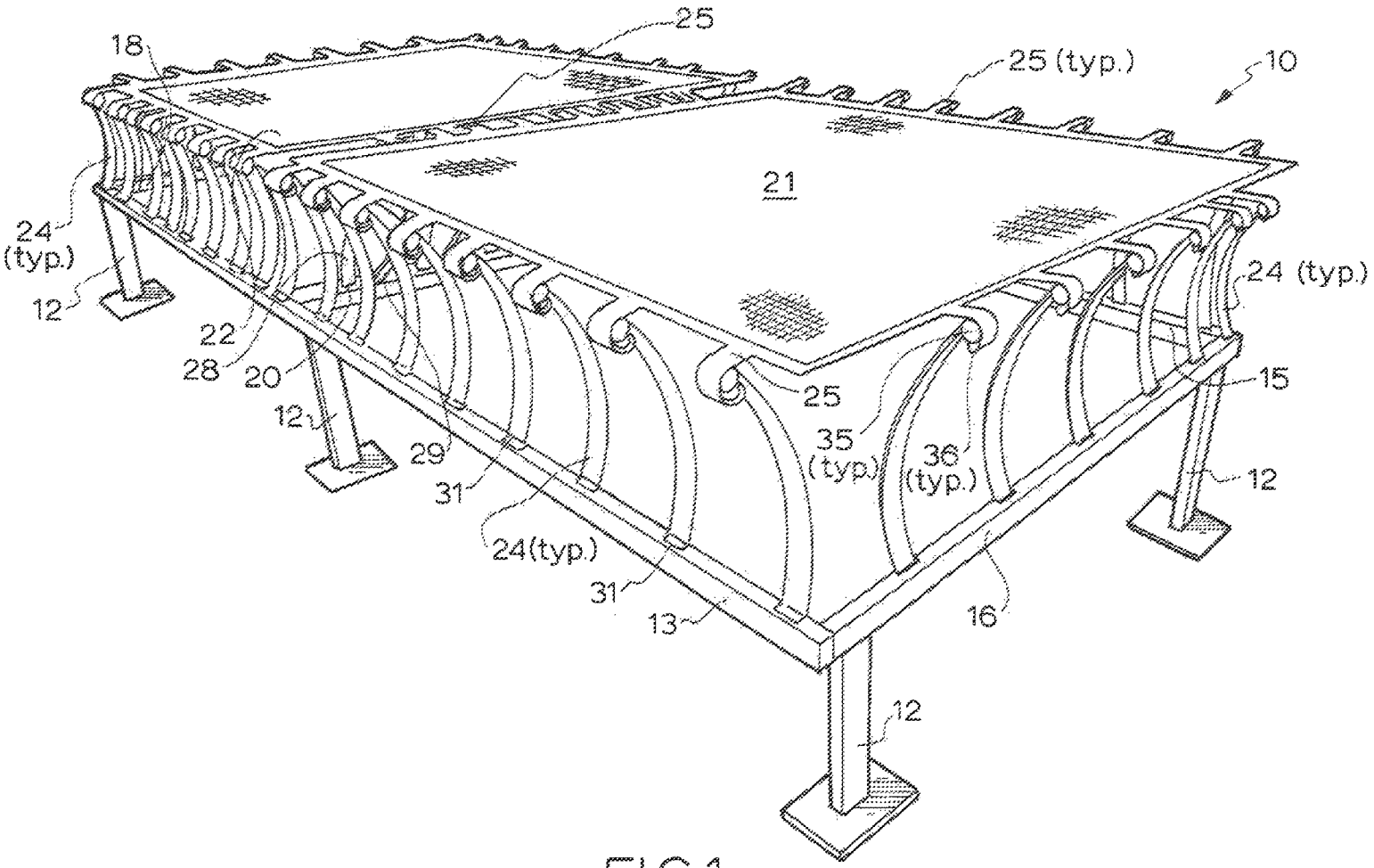
FIG. 1 is a pictorial representation of a trampoline according to the invention with two side by side mats.
Figure 2:
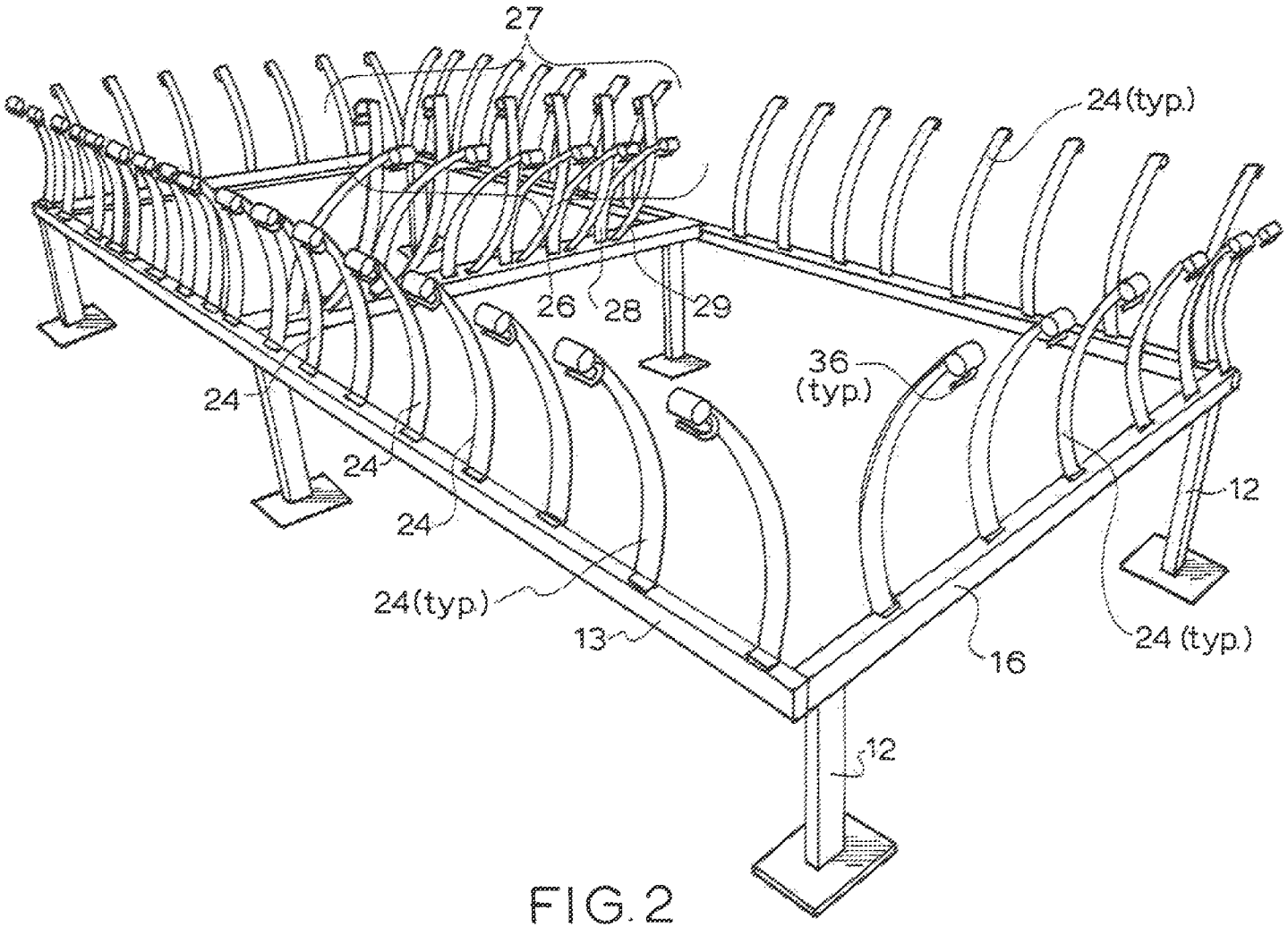
FIG. 2 is a pictorial representation of the trampoline of FIG. 1 with the mats removed for clarity.

The trampoline 10 illustrated in FIG. 1 includes an elevated rectangular bottom frame 11 which is supported on six spaced apart legs 12 welded to the frame 11 at their upper ends, although in other versions the legs are bolted to the frame.

The frame 11 comprises two spaced apart long side members (or rails) 13 and 15, two spaced apart snort side or end members (or rails) 16 and 18 extending between the side members and welded thereto adjacent their respective opposite ends, and a centre cross member 20 also extending between the long side members midway along their length and welded thereto.

The side members and the end members are constructed of 100 mm×50 mm rolled hollow section steel tube while the centre cross member is constructed of 100 mm by 100 mm rolled hollow section steel tube. However other sections and sizes could be used if desired.

Two substantially identical jumping mats 21 (the first mat) and 22 (the second mat) are connected to the frame 11 via a plurality of leaf springs 24 spaced apart around the perimeter of the rectangular frame and two rows 26 and 27 of spaced apart leaf springs 23 and 29 which are the same as perimeter leaf springs 24 extend upwards from the centre cross member 20, row 26 being connected to the first mat 21 and row 27 being connected to the second mat 22.

The leaf springs are all connected to the frame in the same manner by locating their bottom end portions in the hollow of the RHS tube via spaced apart slots 31 respectively which are formed in the upper wall of the tube and parallel to the longitudinal axis of the tube frame and secured therein by virtue of a tight fit in the slot, their weight and the tension applied to the leaf springs by the mats. It will be appreciated that the leaf springs could be mounted directly to the floor of a building, for example by the leaf springs being fitted to a foot mount which in turn is bolted to a concrete slab floor. Alternatively, the leaf springs could be mounted in slots or holes provided in a concrete foundation or slab and grouted therein. However, the steel frame allows the trampoline structures to be manufactured in a factory and simply installed in a suitable building.

Figure 4:
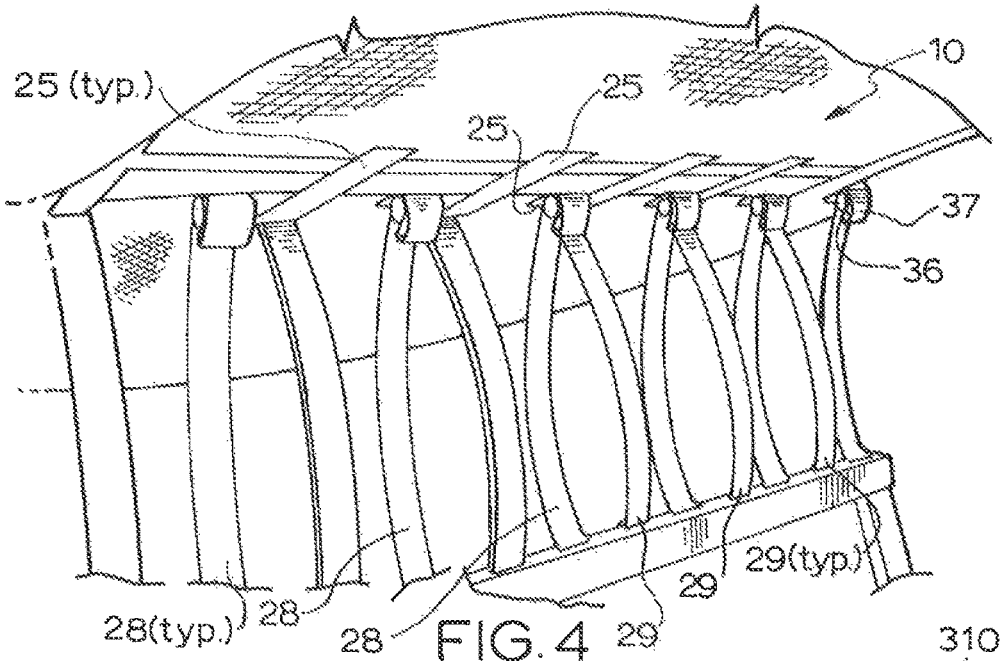
FIG. 4 is a pictorial view of the underside of the trampoline mat of FIG. 1 with the leaf springs connected to the centre frame member connected thereto.

The mats 21 and 22 and so on are connected to the leaf springs by straps 25 formed of a plastics webbing material which wrap around the respective cylindrical heads 35 of the leaf springs and are secured by a securing hook 36 as can be seen more clearly in FIG. 4 with the loops 37 on the end of each strap fitted onto their respective hooks 36.

Figure 5:
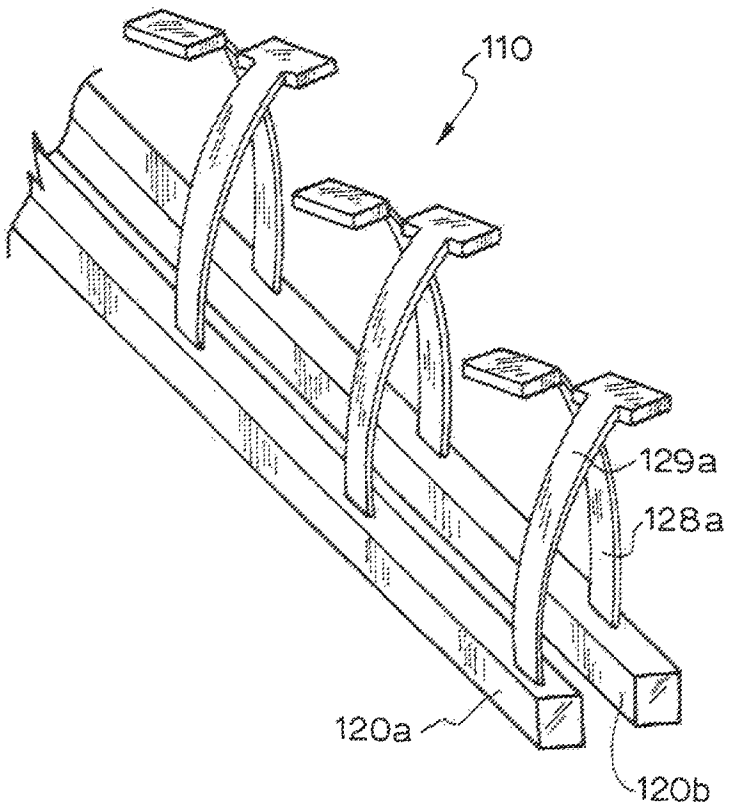
FIG. 5 is a pictorial representation of an alternative centre frame arrangement with two cross members instead of one which could be used in the trampoline of FIG. 1.

The trampoline 10 illustrated schematically in part in FIG. 5 is similar to the trampoline 10 illustrated in FIG. 1 in many respects and accordingly, corresponding reference numbers will be used to reference corresponding components where possible except prefaced by a "1".

The trampoline 110 provides for two adjacent centre cross members 120*a* and 120*b* instead of the single cross member 20 of the trampoline 10 illustrated in FIG. 1 which allows the springs in each row to be placed closer to the springs in the other row along the length of the cross members because the adjacent slots will not weaken the members. It also allows stiffer springs to be used thereby achieving a tighter mat and different mat performance characteristics. The leaf springs 128*a* and 129*a* shown in the trampoline of FIG. 5 are used all around each mat and provide for a different means of connecting the mats thereto as will be clear from the drawings.

Figure 6:
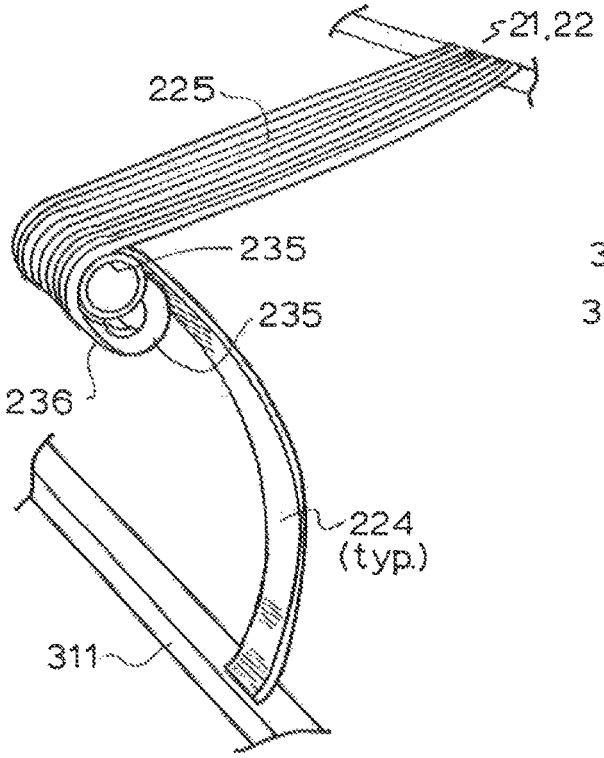
FIG. 6 is a close up pictorial representation of one perimeter leaf spring of the trampoline of FIG. 1 and a small portion of the mat to which it is connected.

The trampoline 210 illustrated in part in FIG. 6 has a slightly different arrangement for connecting the straps 225 to the leaf springs 224 which extend upwards immediately from the frame members 213 to 216 in the same manner as in FIG. 1. The straps 225 ride over the cylindrical head 235 and are secured by the strap holder 236 which looks under the leaf spring.

Figure 7:
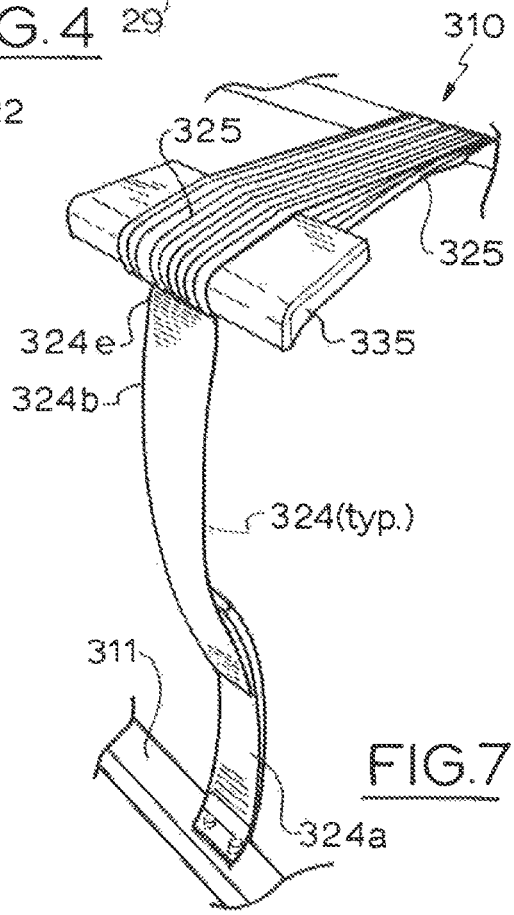
FIG. 7 is a close up pictorial representation of an alternative perimeter leaf spring which could be used in a trampoline like that of FIG. 1 and a small portion of the mat to which it is connected.

The trampoline 310 illustrated in part in FIG. 7 includes leaf springs 324 having a lower portion 324*a* which curves upwards from the bottom frame 311 and outwards and an upper portion 324*b* which is contiguous with the lower portion but is curved upwards and inwards from the lower portion. Advantageously, the upper portion is a thinner leaf giving a lower spring constant for the upper portion to provide different trampoline performance. The head on this trampoline is generally rectangular in plan view and has a relatively flat upper face so as to allow the adjacent mat to rest comfortably thereon. The strap 325 has two sections so that one section can slide onto the head from one side and the other section from the opposite side.

Figure 8:
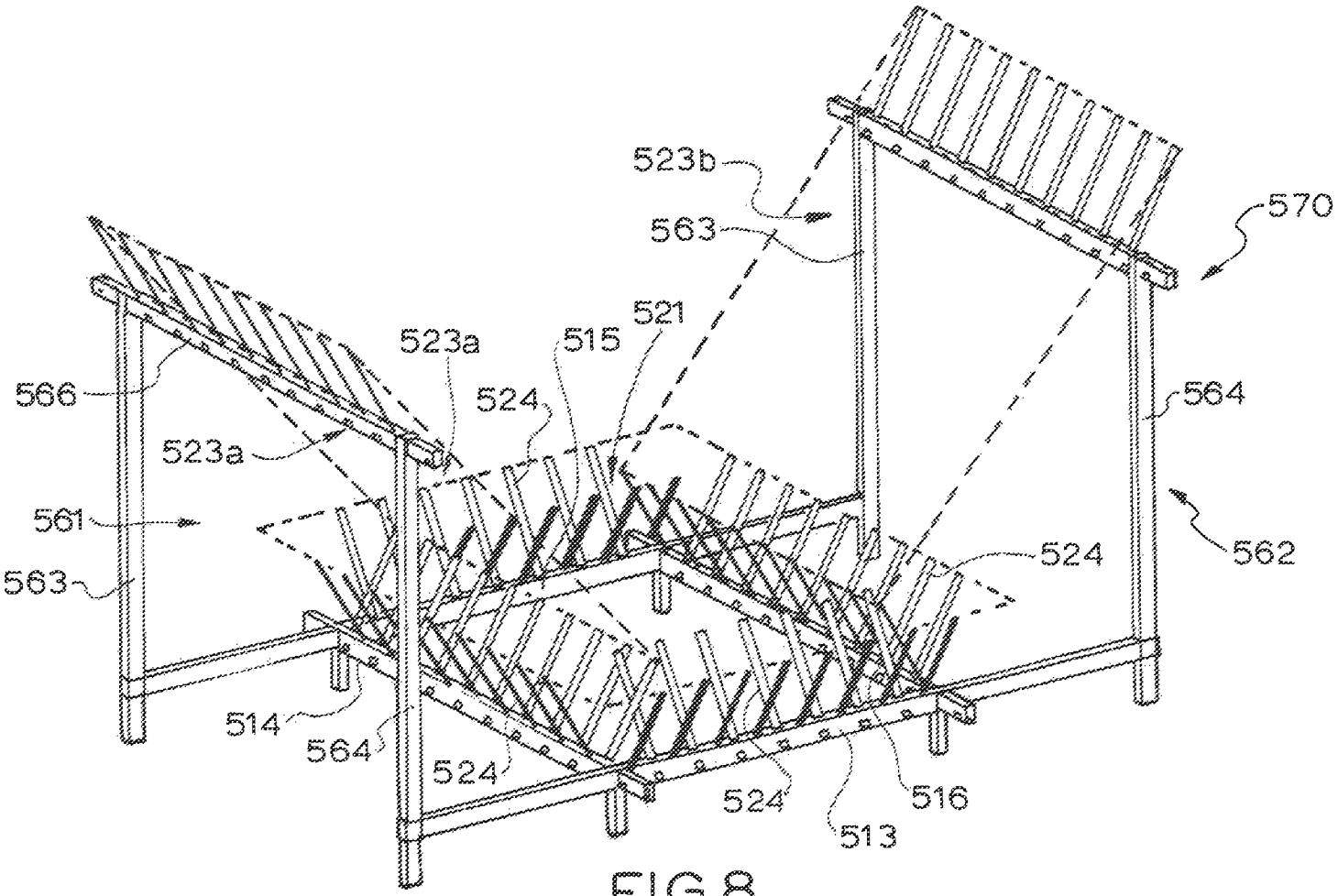
FIG. 8 is a pictorial schematic representation of an alternative trampoline according to the invention having a horizontal mat and an adjacent inclined mat.

The trampoline 510 illustrated schematically in part in FIG. 8 is similar to the trampoline 10 illustrated in FIG. 1 in many respects and accordingly, corresponding reference numbers will be used to reference corresponding components where possible except prefaced by a "5".

The trampoline 510 has three mats, a horizontal centre mat 521 and two generally opposed inclined mats 523*a* and 523*b*, all shown in outline only, which are all mounted on a frame 560. The frame is arranged to join with similar frames for connecting another horizontal mat on either side of the centre mat in banks of similar frame units.

The frame 560 includes a substantially square bottom frame 511 which is similar to one half of frame 11 illustrated in FIG. 1, but the two opposed side members 513 and 515 extend beyond the end members 514 and 516 to meet respective vertical frame portions 561 and 562. Each vertical frame portion includes two vertical posts 563 and 564 and a horizontal top rail 566 extending fully across the upper ends of the two posts which form top rails for the respective inclined mats while the end rails 514 and 516 double as bottom rails for the inclined mats.

Figure 11:
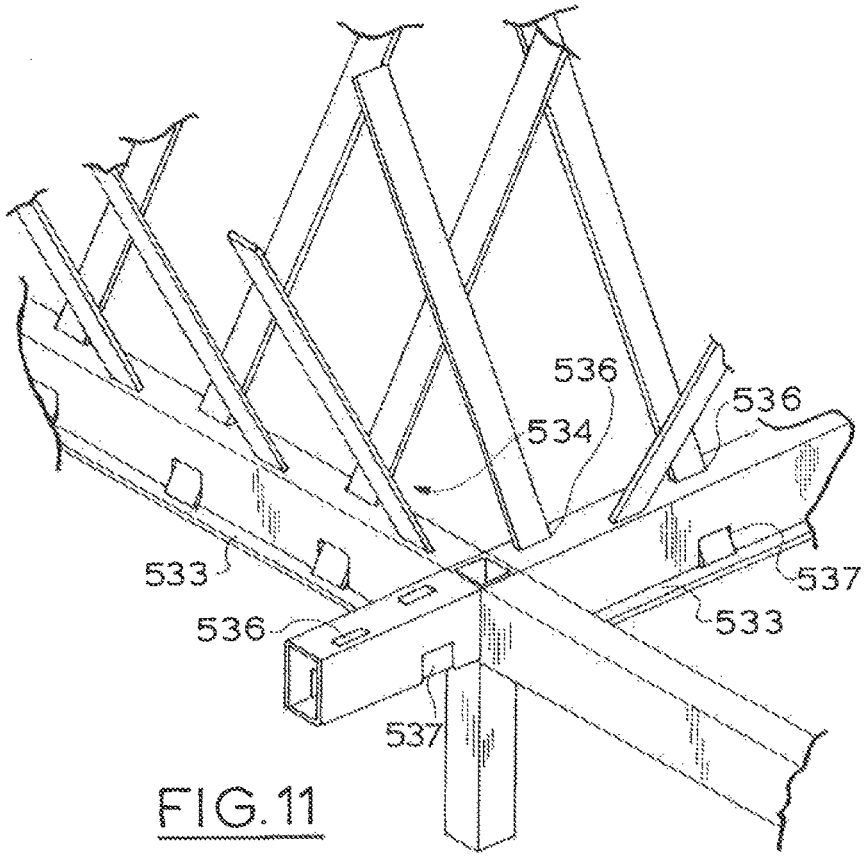
FIG. 11 is a close up pictorial representation of part of the frame for the trampoline of FIG. 8.

The horizontal mat 521 is connected to the leaf springs 524 in much the same arrangement as described in relation to FIG. 1 although the mechanism for doing so is different as will be referred to later. In this arrangement the leaf springs are straight bars of spring steel which are not pre-curved as shown in FIG. 1 but become curved when the mat is connected and under the tension applied to the mat. That is to say, in fitting the mat to the springs, they must be curved inwards to make the connection. Also, the frame members 513, 514, 515 and 516 have a 90 mm×8 mm steel plate welded to the bottom wall thereof to provide shoulders 533 and 534 extending from the opposite sides of the RHS tube and the leaf springs extend through an upper slot 536 in the top wall of the frame members and a lower slot 537 in one side wall or the other to rest on the shoulders 533 or 534 as the case may be as can be more clearly seen in FIG. 11.

Although, trampoline 510 is shown with the inclined mats only being connected to the leaf springs along their bottom edges and top edges, in other embodiments, inclined rails extend from the top rail to the bottom rail and leaf springs are connected to those rails in the same manner as the top and bottom rails to provide side tensioning as in the horizontal mat. In yet another embodiment, where the trampoline is intended to be used in the corner of a room, the inclined mats along one side and one end of the horizontal mat can meet on a diagonal inclined member which has alternately directed leaf springs mounted thereto.

The mats in trampoline 510 are connected to the leaf springs by much the same mechanism illustrated in FIGS. 27 to 36 of application No. PCT/AU2012/000651 and reference may be had to that application for a complete understanding of that mechanism. That mechanism includes a connector block which is moulded from a plastics material and has a curved outer face which is engaged by the mat and bears the tensile load of the mat thereagainst. A passage is provided in the block and a recessed bridge adjacent the passage forms a mount for attachment of the loop end of a hook which hooks onto the leaf spring adjacent its upper end by way of the free end hooking through either one or two holes in the leaf spring.

Each leaf spring comprises three laminated spring steel plates of equal thickness with three layers, at the bottom end reducing to two layers in the mid-section and only one layer nearer the top thereby providing a spring with different spring constants along its length.

Figure 9:
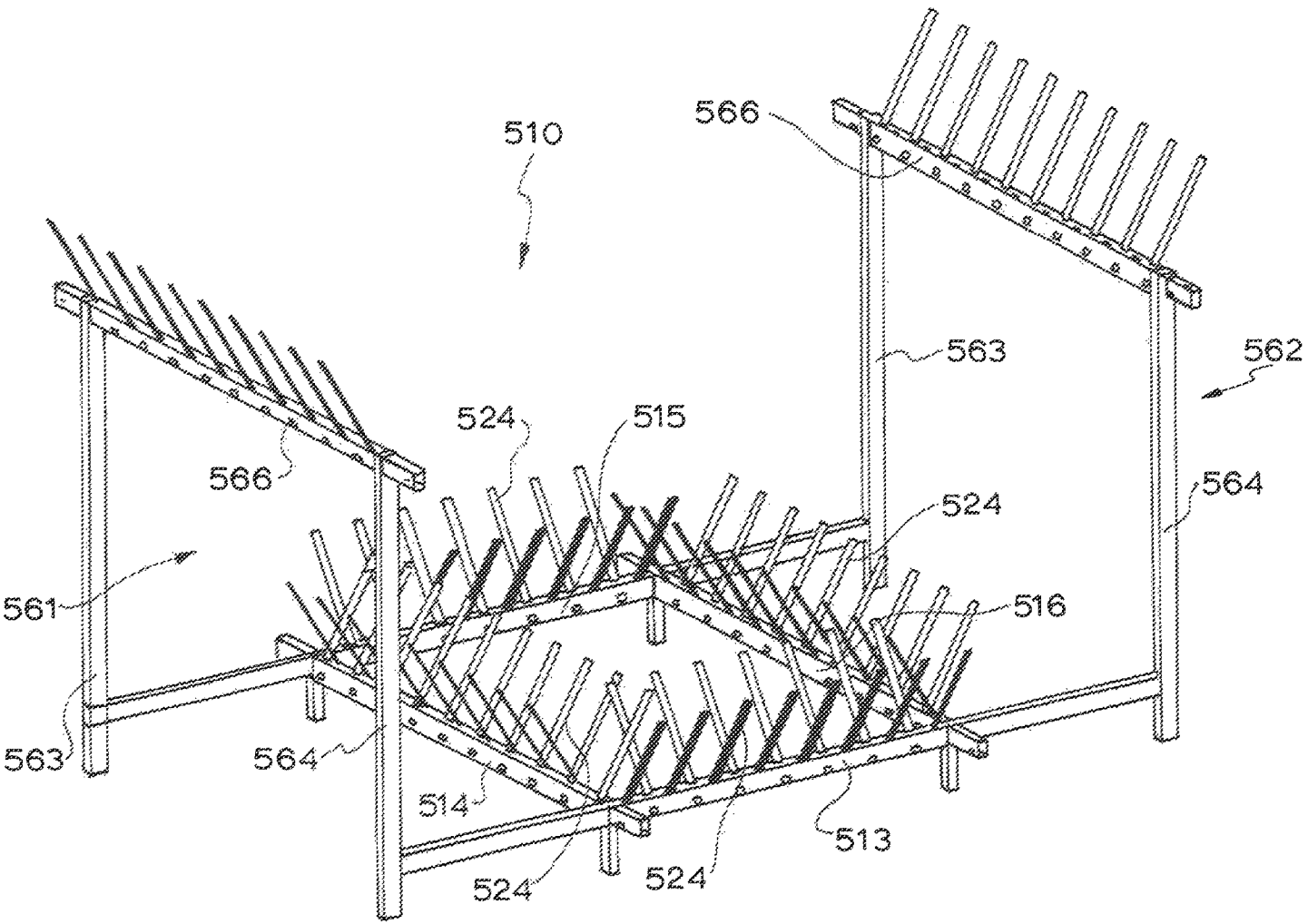
FIG. 9 is a pictorial schematic representation of the alternative trampoline shown in FIG. 8 with the mats removed for clarity.
Figure 9A:
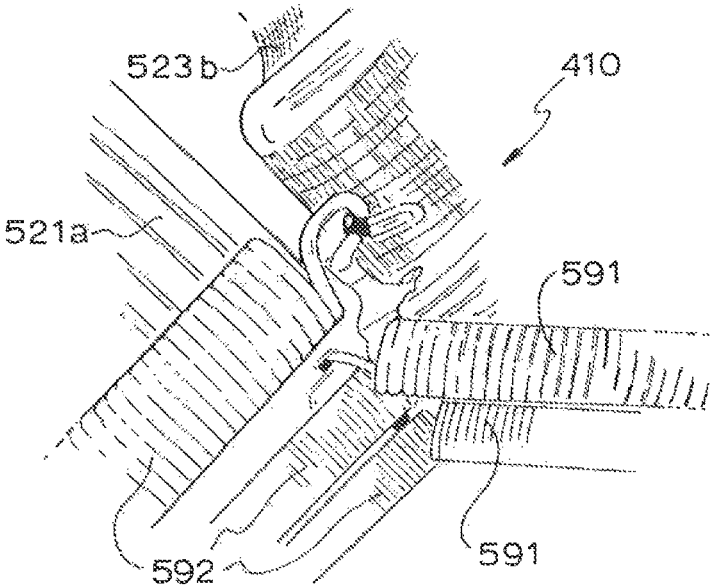
FIG. 9A is a pictorial representation of part of a trampoline having a horizontal mat and an inclined mat similar to that shown in FIGS. 8 and 9 but using extensible coil springs instead of leaf springs at the junction between the horizontal mat and the inclined mat.

In some cases, it is advantageous to use extensible coil springs at the junction between the horizontal mats and the inclined mats as shown in part in FIG. 9A. The trampoline 410 shown in part in FIG. 9A is the same as that illustrated in FIG. 9 except that the leaf springs 524 along cross members 514 and 516 at the junction of the horizontal mat 521 and the inclined mats 523*a* and 523*b* have been replaced by extensible coil springs 591 tensioning the horizontal mat and extensible coil springs 592 tensioning the inclined mat. For that purpose, cross member 516 is relocated to a position under mat 523*b* and substantially aligned with the plane of the upper surface of the mat for connecting springs 591 for the horizontal mat and another cross member of substantially the same form is fitted between members 513 and 515 and aligned substantially with the upper surface of the inclined mat 523*b*.

Figure 10:
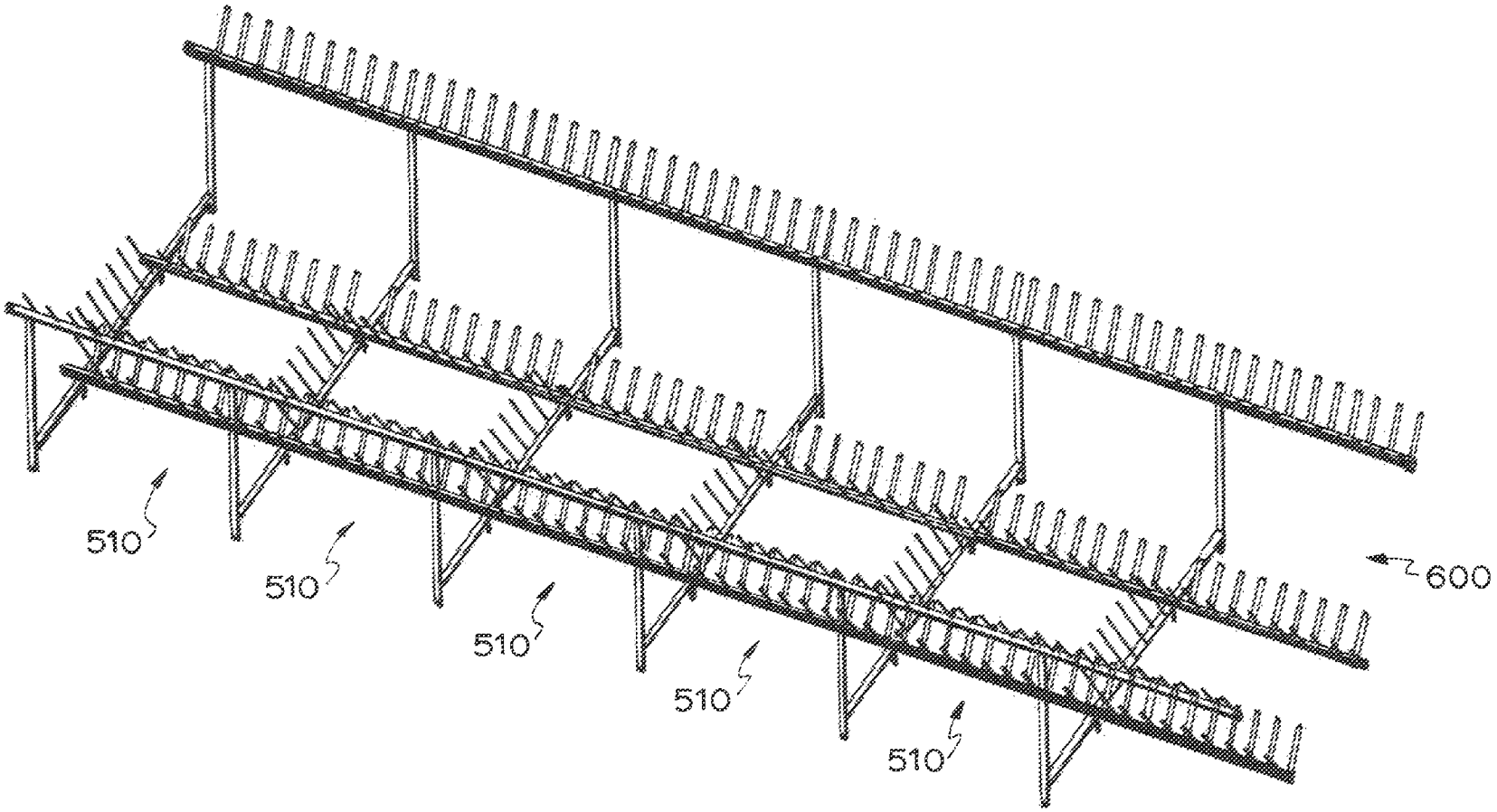
FIG. 10 is a pictorial schematic representation of a bank of trampolines of the type illustrated in FIG. 8 with a run of horizontal mats and adjacent inclined mats on both sides of the run with the mats mounted on interconnected frames, with the mats removed for clarity.

The bank of trampolines illustrated in FIG. 10 is essentially a multiplication of the trampoline 510 illustrated in FIG. 8 with a continuous frame and multiple horizontal mats (not shown) and multiple inclined mats (not shown). However, it will be appreciated that any number of trampolines may be connected together and they need not be connected I a line. That is to say, they can be connected such that the horizontal mats and the inclined mats turn corners to form a maze and various obstacles may be placed at selected points.

Figure 12:
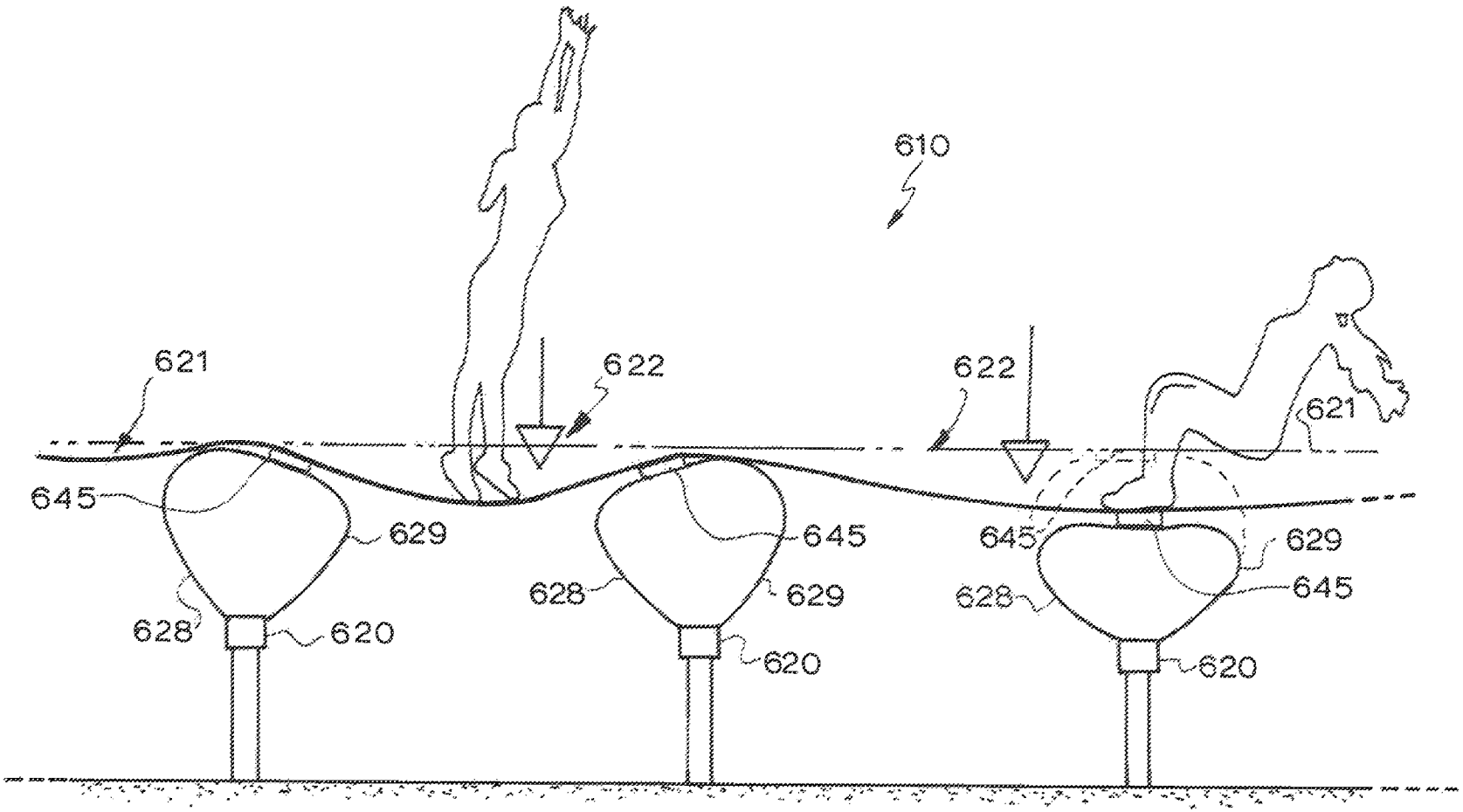
FIG. 12 is a schematic sectional elevation of a multi-mat (or continuous) trampoline (or bank of trampolines) similar to the one illustrated in FIG. 1 with four mats and three intermediate (or "centre") frame cross members with different centre springs attached thereto, the end frames and end springs are not shown)

The trampoline 610 illustrated schematically in part in FIG. 12 is similar to the trampoline 10 illustrated in FIG. 1 in many respects and accordingly, corresponding reference numbers will be used to reference corresponding components where possible except prefaced by a "6".

Figure 3:
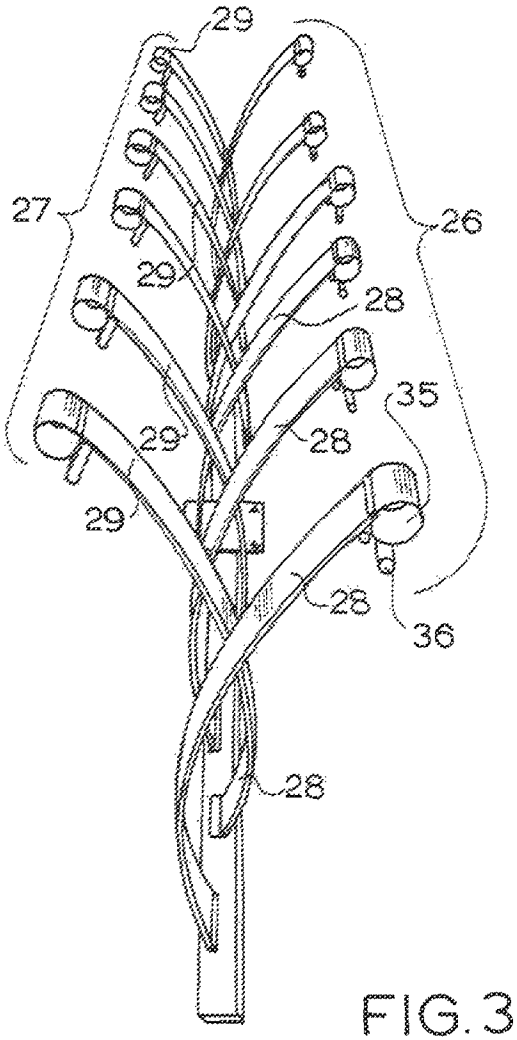
FIG. 3 is a pictorial representation of the centre frame cross member of the trampoline of FIG. 1 with the leaf springs connected thereto and shown in their respective unloaded positions.

The trampoline 610 illustrated in part in FIG. 12 has four mats arranged side by side, that is, two end mats 621 and two intermediate mats 622 and consequently has three centre cross members 620. The perimeter springs 624 (not shown) are the same as the perimeter springs 24 of the trampoline 10 illustrated in FIG. 1. However, the centre springs which are connected to the cross members 620 are different. In that respect, as can be seen more clearly in FIG. 3, the leaf springs 628 and 629 are arranged in opposed spaced apart pairs along the centre cross member 620 and the springs 628 and 629 in each pair extend upwards and outwards from the cross member shown at item 641 to a point about half the distance between the cross member and the mat and then curve inwards towards each other shown at item 642 and terminate in a horizontal portion shown at item 643, the free ends 644 of the two leaf springs being spaced apart but aligned with each other. The two leaf springs are held together at their free ends (their upper ends) by a flexible connector 645 which includes hooks 646 which hook through holes provided in the two leaf springs adjacent their ends such that the connected springs form an upside down bell shape. The two adjacent mats 22 are connected to the flexible spring connector 645 by hooks (not shown). However, in other forms of the invention, the mats are connected to the flexible connector and to each other by similar hooks. It will be appreciated that a person jumping in the centre of one mat will cause the perimeter springs as well as the two rows of springs connected to the adjacent cross member to bias the mat to its at rest disposition with some biasing force being applied by the subsequent rows of centre springs on the other cross members and the final row of perimeter springs. However, when a person jumps on the joint or the joint region, the centre springs underneath the mat will bend down causing the bell shape to belly outwards as the horizontal portions of the leaves move downwards under the load. Advantageously, the arrangement allows for much less or even no padding in the region of the mat joins and also allows the joint region to be a part of the mat which can be jumped on.

Figure 13:
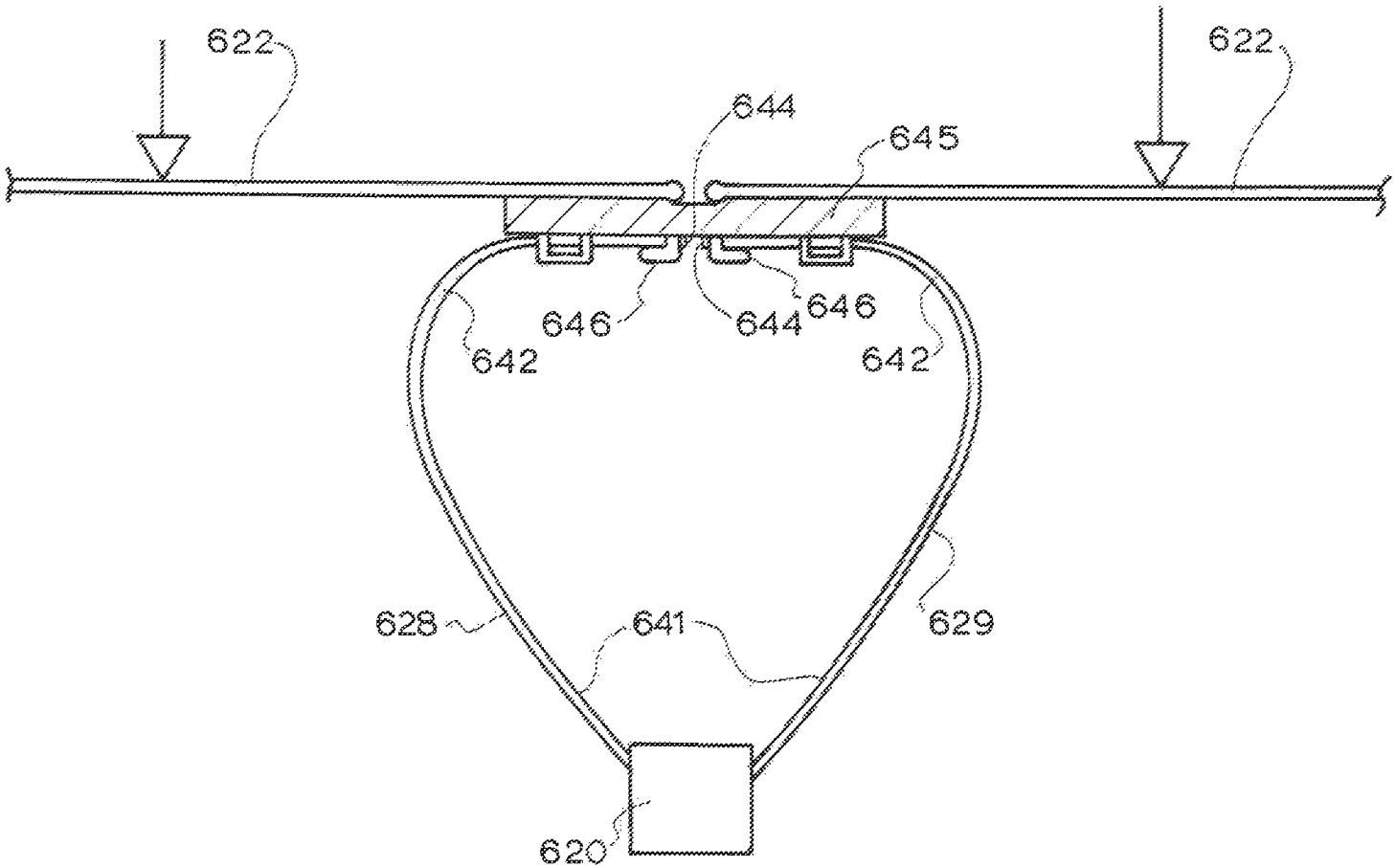
FIG. 13 is a schematic close up view of one centre frame cross member and two opposed springs connected thereto.
Figure 14:
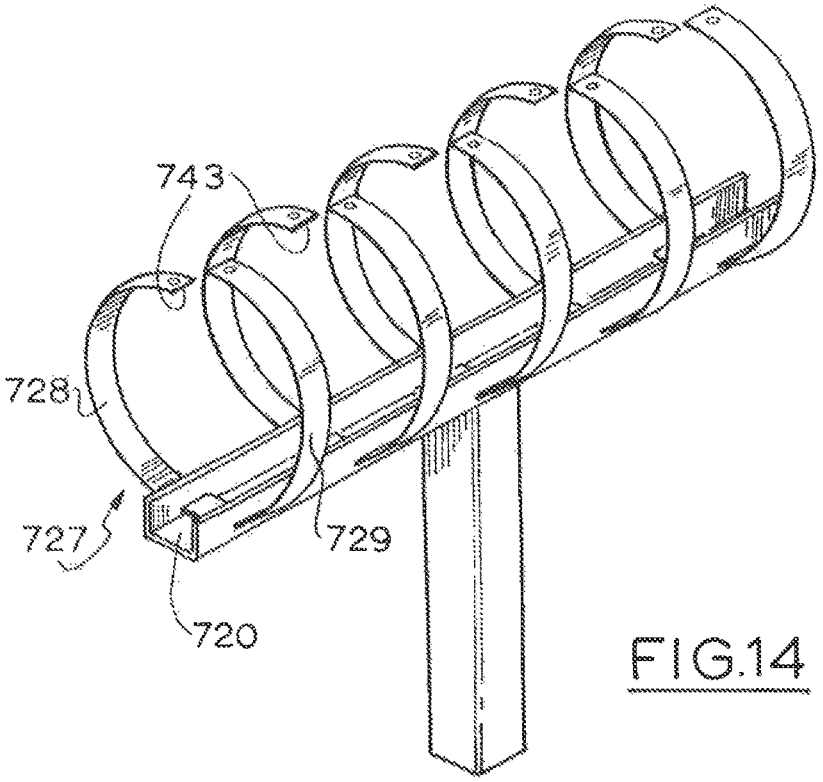
FIG. 14 is a pictorial representation of an alternative centre frame cross member which could be used instead of the centre frame cross member in the trampoline of FIG. 2.

The alternative cross frame member 720 illustrated in FIG. 14 can be used in a trampoline similar to trampoline 610 instead of the cross members 620 shown in FIGS. 12 and 13. Notably, the two springs 628 and 629 shown in trampoline 610 are replaced by a single leaf spring 727 forming an almost circular structure with two opposed halves 728 and 729 corresponding to a large extent with the two divergent leaf springs 628 and 629. However, in this form of the invention, the opposite ends of the circular spring are not aligned and in fact are spaced apart in the direction along the cross member and this result is achieved by forming the circular spring more or less into a single pitch helix.

Figure 15:
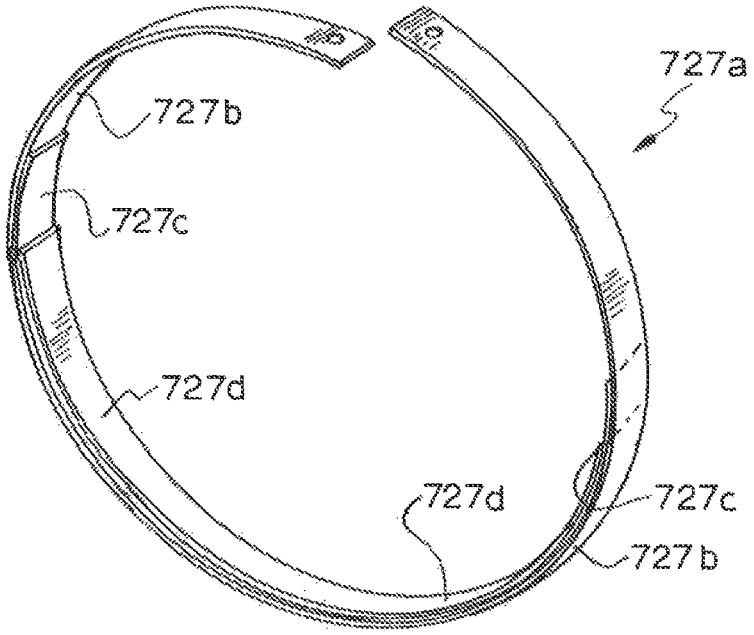
FIG. 15 is a pictorial representation of a multi-leaf leaf spring which can be used with the centre frame cross member of the trampoline of FIG. 2.

The alternative single circular leaf spring 727*a* illustrated in FIG. 15 has the same helical form as the one shown in FIG. 14 but in this case the leaf spring is made up of three leaves, 727*b* on the outside, 727*c* in the middle and 727*d* on the inside. Advantageously, the outside spring runs for the full circle while the middle spring runs for about two thirds of the circle and the inside spring runs for about half the circle, centred on the bottom of the circle, thereby providing a spring which results in a varying spring constant which gives a softer downward characteristic for persons jumping directly on the mat joint and a higher spring constant for persons jumping in the middle of the mat. This arrangement is particularly advantageous for trampoline parks having large numbers of mats operatively connected and large numbers of people jumping on those mats. It will be appreciated that a similar arrangement can be used where inclined "wall" mats are mounted adjacent a horizontal or "floor" mat where the arrangements of FIGS. 14 and 15 can be used to support the joint regions of adjacent wall mats as well as the junction region between floor mats and wall mats. In some cases the arrangement can be used in conjunction with other biasing means such as extensible coil springs at the junction.

Figure 16:
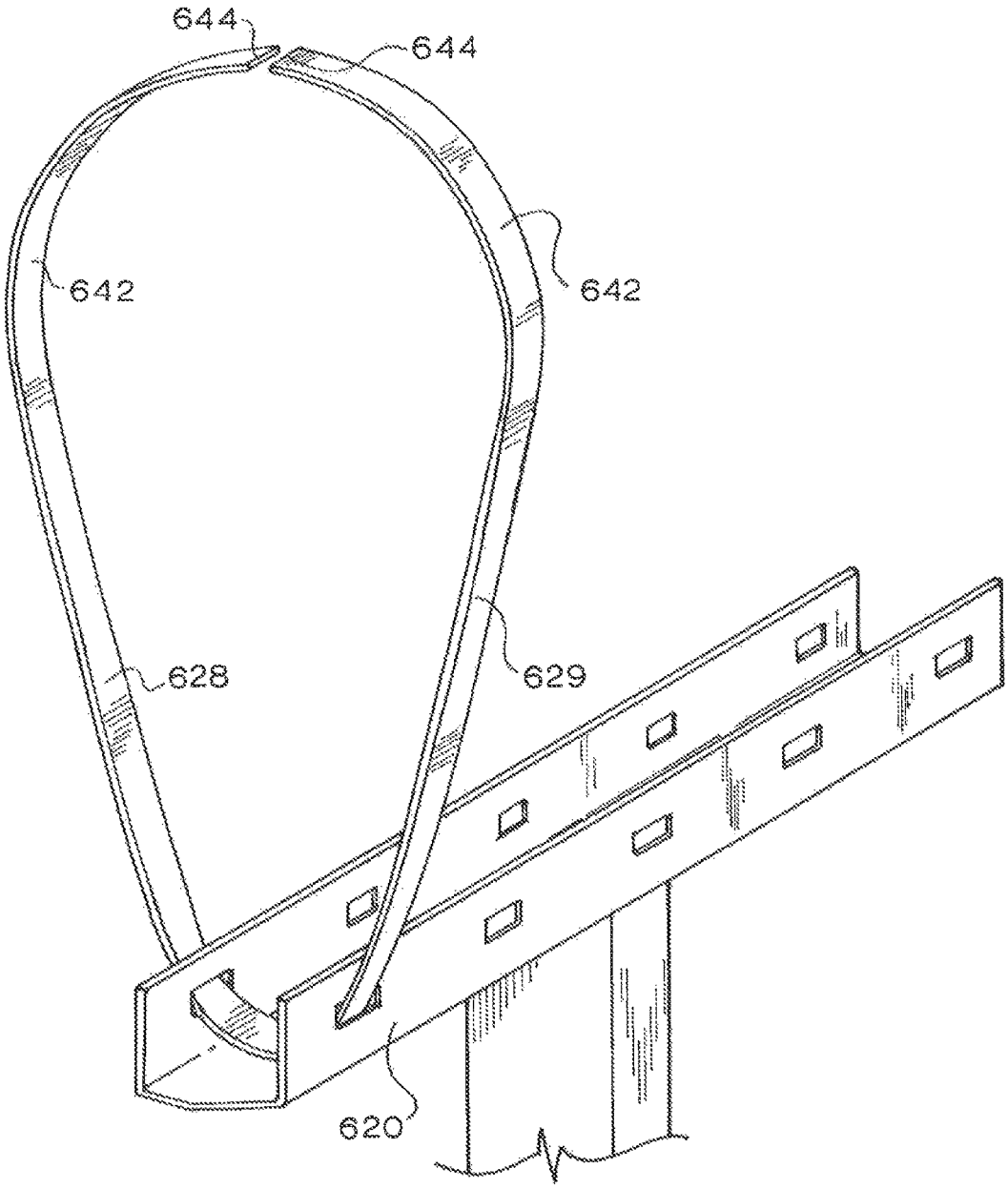
FIG. 16 is a pictorial representation of an alternate arrangement for the centre frame cross member and springs and the spring shown can be provided in multi-leaf arrangement to achieve different characteristics if desired.

The alternative arrangement illustrated in FIG. 16 provides for different performance characteristics while maintaining the relatively horizontal portion at the upper ends of the spring thereby achieving the desired result of a joint region on which a person can jump or at least a region where a person jumping from one mat to the next can land without serious injury thereby obviating the need in prior art trampolines to have large areas of padding between adjacent trampoline mats. It will also be appreciated that variations on the arrangements illustrated can be made, for example, the channel shaped cross-member could be provided in two angle parts to allow for easy assembly and then be clipped together to form the channel.

Figure 17:
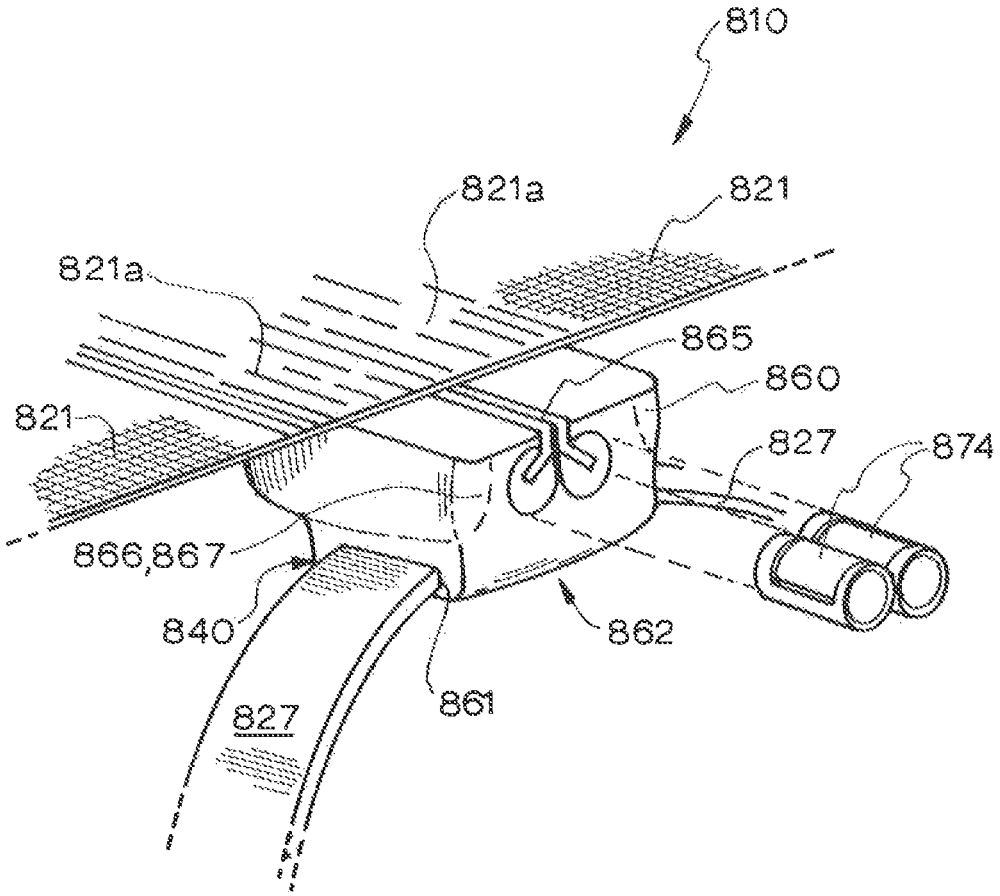
FIG. 17 is a schematic pictorial representation of a portion of a double mat trampoline showing the mat connector fitting and cylindrical leaf spring in part.
Figure 18:
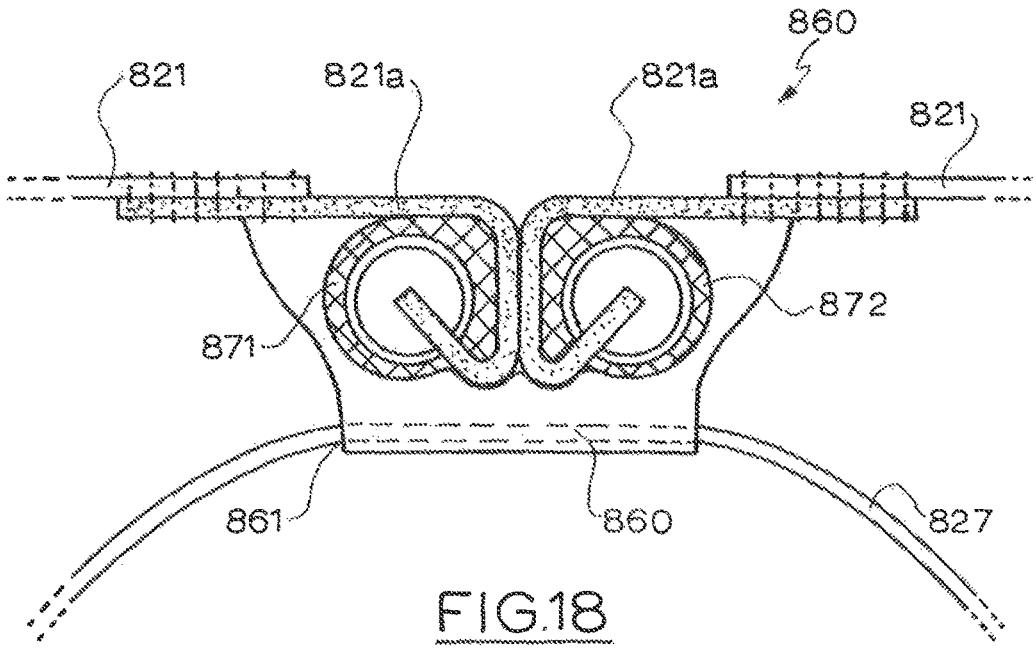
FIG. 18 is a schematic end elevation of the arrangement of FIG. 17.

The trampoline 810 illustrated in part in FIGS. 17 and 18 is similar to the trampoline 610 illustrated in FIG. 12 in many respects and accordingly, corresponding reference numbers will be used to reference corresponding components where possible except prefaced by an "8".

In trampoline 810, instead of a flexible connector 645 connecting the adjacent mats 621 together, a relatively rigid connector 860 is used to connect the mats 821. Additionally, the two mats have an elastic edge portion 821*a* at their adjoining edges. Further, the leaf springs 327 at the connecting portion of the two mats 821 are similar to the leaf springs illustrated in FIG. 15 in that they are generally cylindrical in form, although they are not helical but instead have their free ends aligned. However, in trampoline 810, the cylindrical leaf springs 827 have their free ends secured in the centre mounting frame member 820 (not shown) in an overlapping manner with a bolt through and the upper centre portion of each spring referenced as item 840 rests in a slot 861 provided in the connector housing 862 and is continuous through the connector housing. In a similar arrangement the free ends are located in slot 86 and secured therein by screws or bolts 880 while the centre portions fits through slots as illustrated in FIG. 14.

Figure 19:
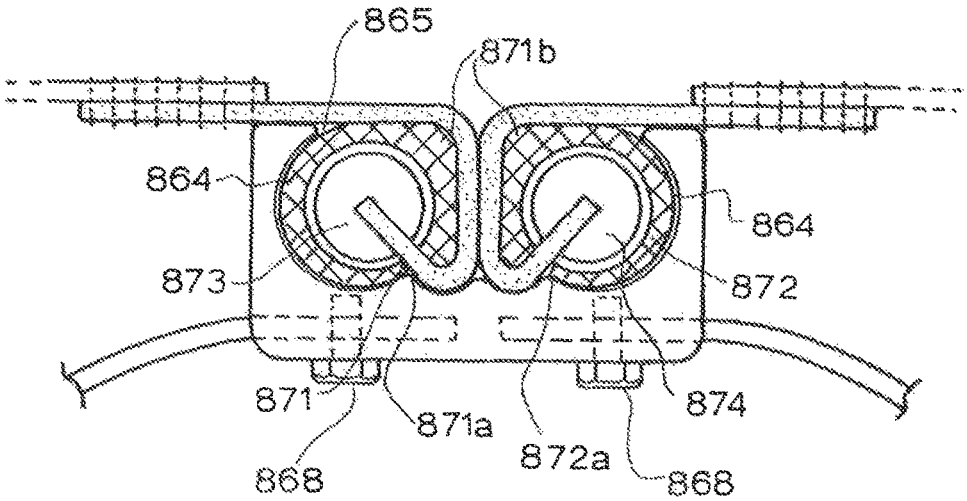
FIG. 19 is a schematic end elevation of the arrangement of FIG. 17 with a slightly different connector.

The connector housing 862 is constructed of a rigid plastics material and has a longitudinally extending cavity 864 provided therein (in the direction of the edges of the mats to be connected). The cavity opens upwards towards the mat at longitudinal opening 865 to allow the two mat edge portions to be fitted therethrough. The cavity also opens to the opposite end faces 866 and 867. As can be seen in FIGS. 18 and 19, the connector includes two longitudinally extending slightly flexible but resilient tubes 871 and 872 (formed of a hardened rubber compound) which rest in the cavity 864 in slightly spaced apart relationship and the edge portions of the two mats are fitted over the respective tubes and engage in slots 871*a* and 872*a* provided therein. It will be appreciated that the outer face of the tubes engage the inner face of the cavity 864 so as to inhibit rolling of the tubes and the upper opening 865 is sized to prevent the tubes rolling out of the cavity. Notably, the tubes 871 and 872 are shaped to provide relatively sharp corners 871*b* and 872*b* to sharpen the corners of the mat thereby providing a somewhat invisible joint.

The edge portions of the mats are also respectively held in their rubber tubes by flexible fibreglass rods 873 and 874 which have slots 873*a* and 874*a* provided therein along their lengths. Notably, rods 873 and 874 extend across the full length of the adjoining mats and connect all the mat connectors 860 connecting the mats 821 together. That is to say, the fibreglass rods 873 and 874 lock the respective mat edge portions in their respective rubber tubes 871 and 872 and also hold the connectors together although the flexibility of the fibreglass rods allows some relative movement between adjacent connectors. Suitably, in the trampoline 810 illustrated, the connectors are slightly spaced apart and a connector "clip" 874 is fitted to the two fibreglass rods 873 and 874 to hold them together between adjacent connectors thereby assisting the connector blocks to hold the two mats together. In this case, the clip is formed of two abutting steel tubes welded together but in other forms it could be manufactured of a suitable plastics material.

It will be appreciated that trampoline 810 provides a trampoline with a concealed joint between adjacent mats which can be jumped on without danger of injury. Further, the cylindrical arrangement of leaf springs provides support for the adjoining mats at the joint area and the elastic edge portion of the adjoining mats provides some mitigation of double bounce.

In other arrangements, instead of separate cylindrical leaf springs, a continuous helical leaf spring can be "screwed" into adjoining connectors to achieve a similar result. However, such arrangement makes replacement and maintenance more difficult.

Figure 20:
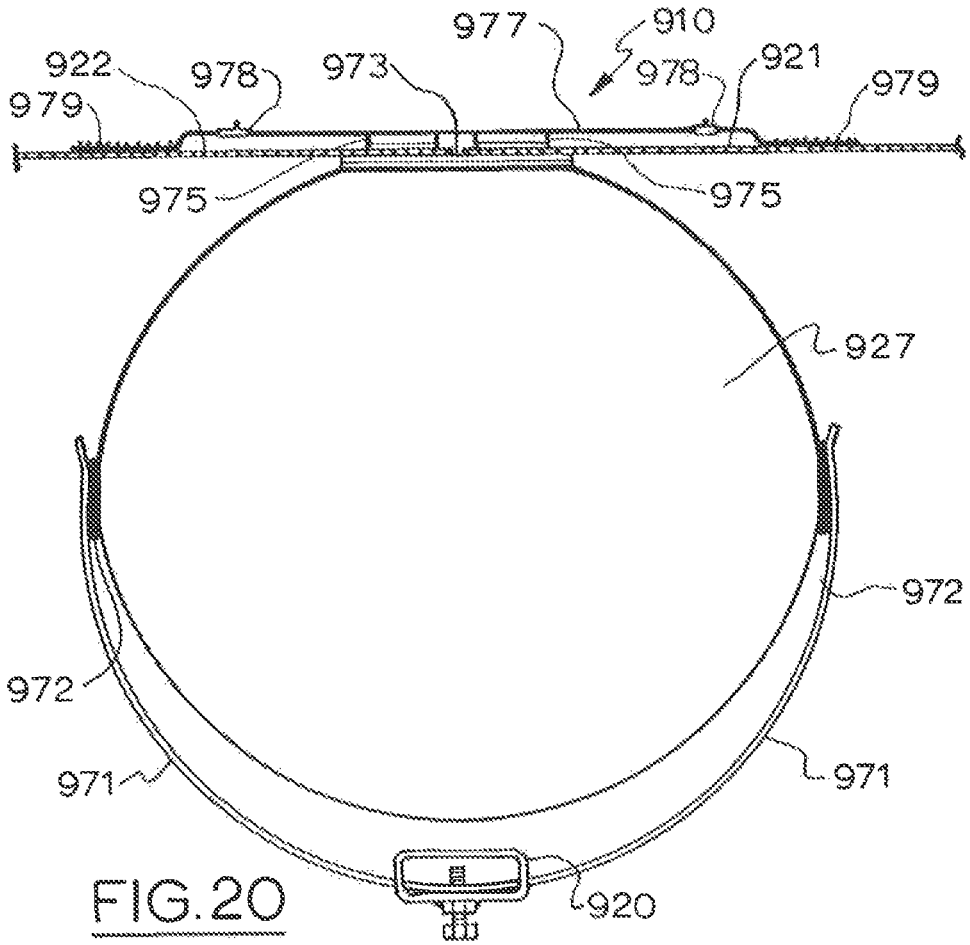
FIG. 20 is a sectional end elevation of the connecting part of another trampoline according to the invention.
Figure 21:
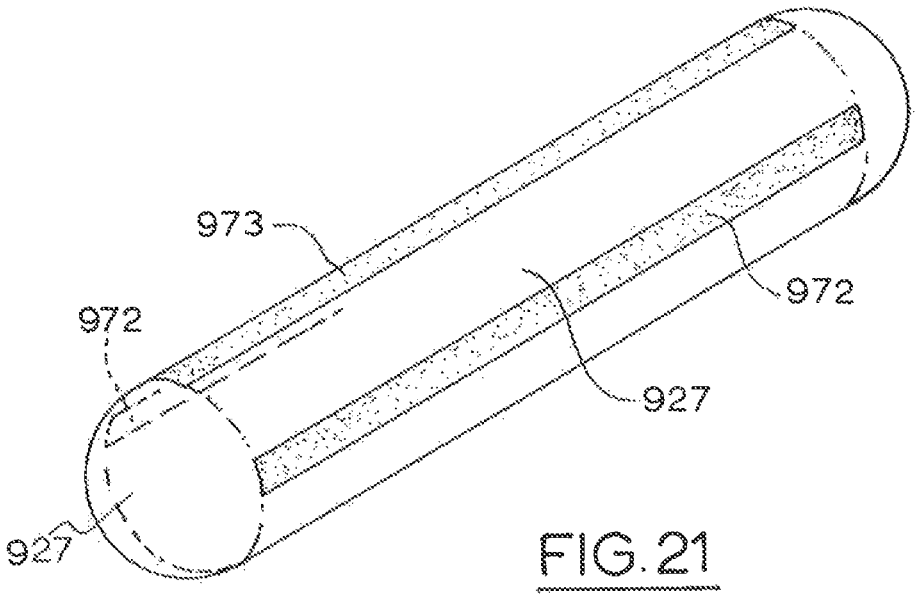
FIG. 21 is a pictorial representation of the inflatable air bag used in the trampoline of FIG. 20.

The trampoline 910 illustrated in part in FIG. 20 includes a plurality of side by side mats connected along their outer edges to leaf springs in the same manner as the trampoline illustrated in FIG. 1. However, in this example, the mats 921 and 922 are held together by spaced apart strips 973 of hook and loop fasteners such as that commonly known as "VELCRO" extending fully along the joint with a cover strip 977 of mat fabric thereover which in turn is secured to the respective adjoining mats along both edges by zippers 978 and stitching 979 extending fully across the adjoining mats. In this case, instead of having springs 28 and 29 as in the trampoline of FIG. 1 or springs 827 of trampoline 810, the biasing means at the joint region of the two mats includes an elongate hydrostatic air bag 927 extending fully across the two trampoline mats under the joint line and the mats are secured thereto by a wide strip of hook and loop fasteners 994 such as "VELCRO". As can be seen in FIG. 21 the hydrostatic air bag is secured to the frame member 920 by leaf springs 971 spaced apart alone the length of the bag which in turn are secured to the bag by strips of hook and loop fasteners 972. Advantageously the leaf springs bias the bag to the centre of the frame member 920 as the bag tends to roll from side to side under the action of persons jumping on the adjacent mats and the bag accommodates jumping at the joint area while biasing the adjoining mats upwards.

Figure 22:
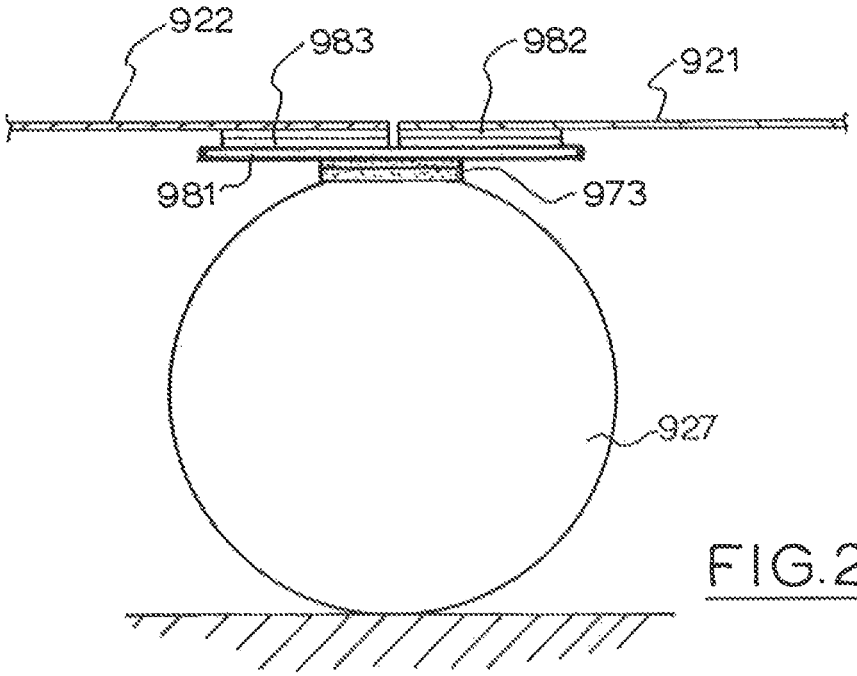
FIG. 22 is a sectional end elevation of the connecting part of another trampoline according to the invention which is similar to the one shown in FIG. 20.
Figure 23:
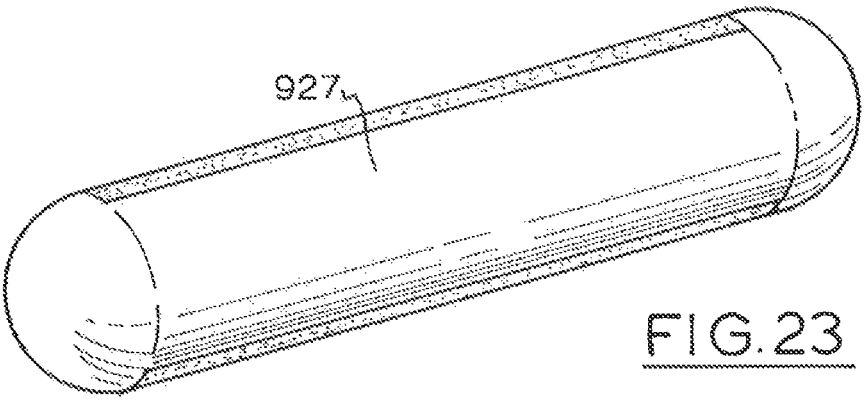
FIG. 23 is a pictorial representation of the inflatable air bag used in the trampoline of FIG. 22.

The alternate connection shown in FIG. 22 also uses hydrostatic air bag 927 but in this case an "intermediate mat" 981 is connected to the bag by hook and loop fasteners 973 and the two jumping mats 921 and 922 are connected to the intermediate mat by hook and loop fasteners 982 and 983.

Figure 24:
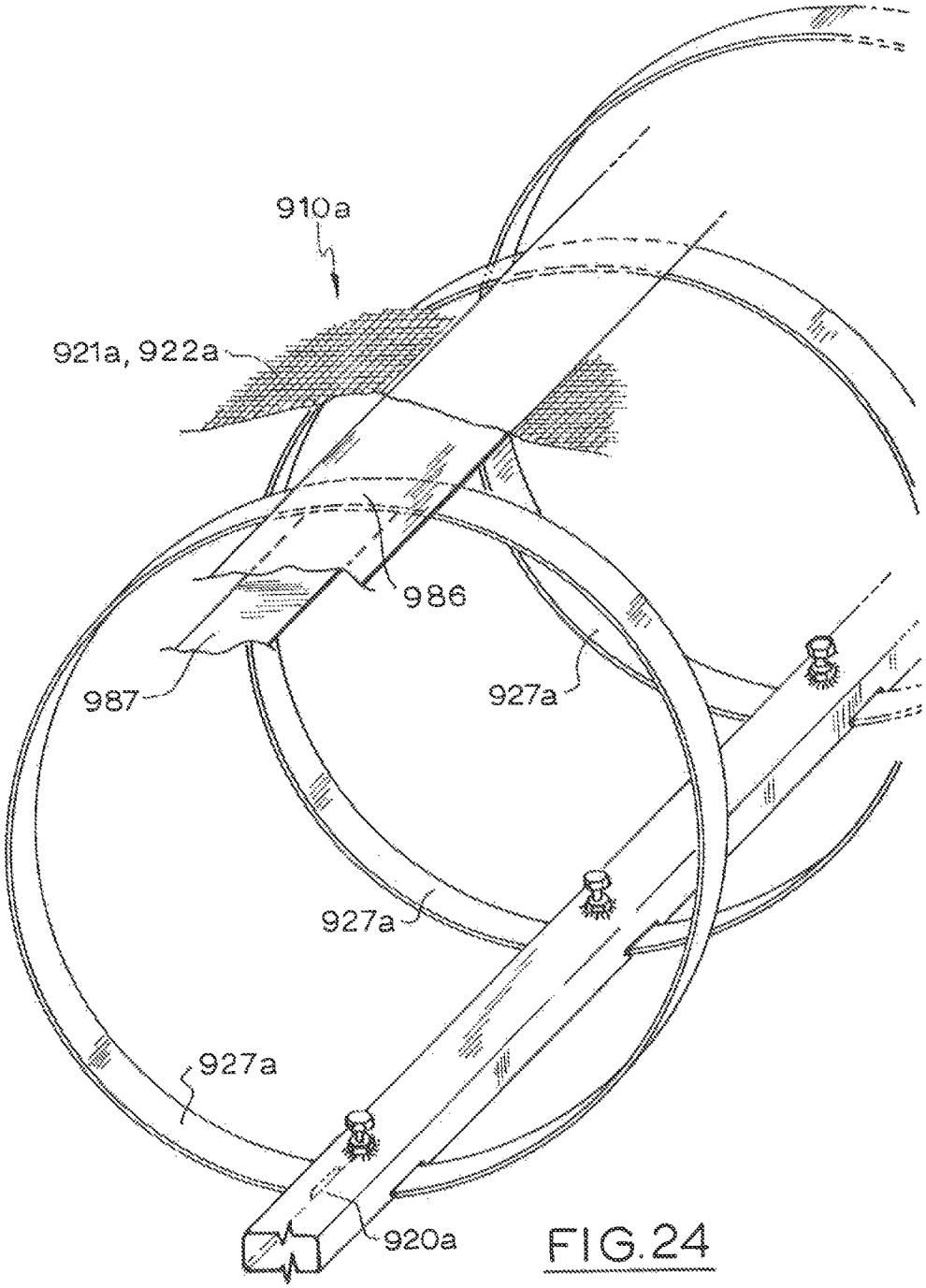
FIG. 24 is a pictorial representation of the connecting part of another trampoline according to the invention where a continuous mat is connected to closed loop leaf springs.

The trampoline 910*a* illustrated in part in FIG. 24 is similar to trampoline 910 in some respects and to trampoline 810 in some respects. In that regard, as can be seen in FIG. 24, trampoline 810 uses a plurality of spaced apart "cylindrical" leaf springs 927*a* which are mounted to cross member 920*a* by their free ends extending into the cross member, overlapping and bolts 968 extending therethrough to secure them to the frame and to each other. The mat or mats are connected to the cylindrical leaf springs via loops 986 provided on the underside of mat 921*a*, 922*a* as the case may be. The loops are formed by a strip 987 of webbing cloth which is stitched to the mat on its underside in a broken manner to provide spaced apart sleeves for the leaf springs. This arrangement is particularly advantageous with continuous mats and is relatively simple.

The foregoing description has been given by way of illustrative example of the invention and many modifications and variations which will be apparent to persons skilled in the art may be made without departing from the spirit and scope of the invention as described herein or defined by the appended claims.

The invention claimed is:

1. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

said flexible and resilient plates comprise leaf springs having first and second free ends, said leaf springs being operatively connected to said frame at said first free end and wherein the first adjacent jumping mat is operatively connected to the leaf springs of the first set of biasing means at the second free end thereof and the second adjacent jumping mat is operatively connected to the leaf springs of the second set of biasing means at the second free end thereof;

the first and second adjacent jumping mats are connected to the respective second free ends of the leaf springs in a manner whereby downward force applied to either or both of the first and second adjacent jumping mats by jumping thereon produces relative movement of the respective second free ends towards each other.

2. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

wherein the first and second sets of biasing means comprise pairs of opposed leaf springs, the leaf springs of each of said pairs being connected to said frame at a first end thereof and diverging away from said frame and curving inwards towards each other adjacent the respective second ends thereof so as to provide a horizontal portion above said frame.

3. A trampoline system according to claim 2 including mat connection means operatively connecting said horizontal portions of said pairs of leaf springs such that the pairs of leaf springs move together to transfer forces between the first and second adjacent jumping mats.

4. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

wherein the first and second adjacent jumping mats are operatively connected to their respective first and second sets of biasing means via respective mat connectors adapted to hold the first and second adjacent jumping mats together;

wherein respective mat connectors of the first and second sets of biasing means are opposed and connected to each other by a flexible and resilient force transferring means.

5. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

wherein the first and second adjacent jumping mats are operatively connected to their respective first and second sets of biasing means via respective mat connectors adapted to hold the first and second adjacent jumping mats together;

wherein said mat connectors include an additional mat portion which is reversibly detachable from the first and second adjacent jumping mats for detachment of the adjacent mats from each other and from the first and second sets of biasing means so that individual mats can be removed.

6. A trampoline system including:

a frame comprising a first frame portion and a second frame portion;

a plurality of spaced apart first biasing means comprising axially spaced flexible and resilient plates connected to said first frame portion and extending upwards therefrom;

a first jumping mat operatively connected to said plurality of first biasing means about a first perimeter portion thereof, each of said first biasing means being arranged to bias said first jumping mat outwards or upwards to keep it taut;

a plurality of spaced apart second biasing means comprising axially spaced flexible and resilient plates connected to said second frame portion and extending upwards therefrom;

a second jumping mat operatively connected to said plurality of second biasing means about a first perimeter portion thereof, each of said second biasing means being arranged to bias said second jumping mat outwards or upwards to keep it taut;

said second mat being inclined relative to said first mat and the first perimeter portion of the second mat being adjacent the first perimeter portion of the first mat, wherein the first and second biasing means are arranged to respectively bias the first and second mats towards each other.

7. A trampoline system according to claim 6 wherein the first biasing means are axially spaced apart in alternate relationship with the second biasing means along the respective first perimeter portions of said first and second mats.

8. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

further comprising a third set of biasing means arranged about the perimeter of the plurality of jumping mats;

wherein the third set of biasing means comprise spaced apart coil springs having their axes aligned with the plane of the upper surface of the jumping mat to which they connect.

9. A trampoline system including:

a frame;

first and second sets of biasing means, each set comprising axially spaced flexible and resilient plates mounted to said frame and extending upwards therefrom; and a plurality of jumping mats arranged in side by side relationship and comprising first and second adjacent jumping mats respectively and operatively connected along their respective adjacent portions to one of the first and second sets of biasing means above said frame, wherein the first and second sets of biasing means are arranged to respectively bias the first and second adjacent jumping mats towards each other;

wherein the first adjacent jumping mat is inclined relative to the second adjacent jumping mat.

* * * * *